US010511073B2

(12) United States Patent
Miller et al.

(10) Patent No.: US 10,511,073 B2
(45) Date of Patent: Dec. 17, 2019

(54) SYSTEMS AND METHODS FOR MANUFACTURING STACKED CIRCUITS AND TRANSMISSION LINES

(71) Applicant: Nuvotronics, Inc., Radford, VA (US)

(72) Inventors: David Anthony Miller, Apex, NC (US); Hooman Kazemi, Thousand Oaks, CA (US); Ankush Mohan, Thousand Oaks, CA (US); Yoonyoung Jin, The Woodlands, TX (US)

(73) Assignee: CUBIC CORPORATION, San Diego, CA (US)

( * ) Notice: Subject to any disclaimer, the term of this patent is extended or adjusted under 35 U.S.C. 154(b) by 2 days.

(21) Appl. No.: 15/532,291

(22) PCT Filed: Dec. 1, 2015

(86) PCT No.: PCT/US2015/063192

§ 371 (c)(1),
(2) Date: Jun. 1, 2017

(87) PCT Pub. No.: WO2016/094129

PCT Pub. Date: Jun. 16, 2016

(65) Prior Publication Data

US 2018/0026324 A1 Jan. 25, 2018

Related U.S. Application Data

(60) Provisional application No. 62/086,939, filed on Dec. 3, 2014.

(51) Int. Cl.
*H01P 3/12* (2006.01)
*H01P 5/12* (2006.01)
(Continued)

(52) U.S. Cl.
CPC ..... *H01P 3/12* (2013.01); *H01P 3/003* (2013.01); *H01P 3/088* (2013.01); *H01P 3/121* (2013.01);
(Continued)

(58) Field of Classification Search
CPC .. H01P 3/121; H01P 3/12; H01P 3/123; H01P 1/042
(Continued)

(56) References Cited

U.S. PATENT DOCUMENTS 2,743,505 A 5/1956 George
2,812,501 A 11/1957 Sommers
(Continued)

FOREIGN PATENT DOCUMENTS

CA 2055116 A1 5/1992
DE 3623093 A1 1/1988
(Continued)

OTHER PUBLICATIONS

"Multiplexer/LNA Module using PolyStrata®," GOMACTech-15, Mar. 26, 2015.
(Continued)

*Primary Examiner* — Stephen E. Jones
(74) *Attorney, Agent, or Firm* — Niels Haun; Dann, Dorfman, Herrell & Skillman

(57) ABSTRACT

Devices and methods for manufacturing RF circuits and systems in both passive and active forms are contemplated herein. Exemplary devices include 3D electrical and mechanical structures which are created from individual slices which may be assembled to create a final functional block such as a circuit, component or a system. The slices may fabricated by a variety of manufacturing techniques, such as micromachined layer-by-layer metal batch processing.

20 Claims, 15 Drawing Sheets

(51) Int. Cl.

| | |
|---|---|
| ***H01P 11/00*** | (2006.01) |
| ***H01P 3/00*** | (2006.01) |
| ***H01P 3/08*** | (2006.01) |
| *H01P 5/107* | (2006.01) |
| *H01P 5/19* | (2006.01) |

(52) U.S. Cl.
CPC ..... *H01P 5/12* (2013.01); *H01P 11/002* (2013.01); *H01P 11/003* (2013.01); *H01P 5/107* (2013.01); *H01P 5/19* (2013.01)

(58) Field of Classification Search
USPC ..... 333/239, 248, 208, 209
See application file for complete search history.

(56) References Cited

U.S. PATENT DOCUMENTS 2,914,766 A 11/1959 Butler
2,997,519 A 8/1961 Hines
3,157,847 A 11/1964 Williams
3,309,632 A 3/1967 Trudeau
3,311,966 A 4/1967 Henry
3,335,489 A 8/1967 Grant
3,352,730 A 11/1967 Murch
3,464,855 A 9/1969 Quintana
3,517,847 A 6/1970 Guala
3,526,867 A 9/1970 Keeler, II
3,537,043 A 10/1970 Smith
3,560,896 A 2/1971 Essinger
3,577,105 A 5/1971 Jones, Jr.
3,598,107 A 8/1971 Ishikawa
3,760,306 A 9/1973 Spinner
3,775,844 A 12/1973 Parks
3,789,129 A 1/1974 Ditscheid
3,791,858 A 2/1974 McPherson
3,884,549 A 5/1975 Wang
3,925,883 A 12/1975 Cavalear
3,963,999 A 6/1976 Nakajima
4,021,789 A 5/1977 Furman
4,033,656 A 7/1977 Freehauf
4,075,757 A 2/1978 Malm
4,275,944 A 6/1981 Sochor
4,348,253 A 9/1982 Subbarao
4,365,222 A 12/1982 Lampert
4,414,424 A 11/1983 Mizoguchi
4,417,393 A 11/1983 Becker
4,437,074 A 3/1984 Cohen
4,521,755 A 6/1985 Carlson
4,539,534 A 9/1985 Hudspeth
4,581,301 A 4/1986 Michaelson
4,591,411 A 5/1986 Reimann
4,641,140 A 2/1987 Heckaman
4,647,878 A 3/1987 Landis
4,663,497 A 5/1987 Reimann
4,673,904 A 6/1987 Landis
4,677,393 A 6/1987 Sharma
4,684,181 A 8/1987 Massit
4,700,159 A 10/1987 Jones
4,717,064 A 1/1988 Popielarski
4,729,510 A 3/1988 Landis
4,771,294 A 9/1988 Wasilousky
4,808,273 A 2/1989 Hua
4,832,461 A 5/1989 Yamagishi
4,853,656 A 8/1989 Guillou
4,856,184 A 8/1989 Doeling
4,857,418 A 8/1989 Schuetz
4,859,806 A 8/1989 Smith
4,876,322 A 10/1989 Budde
4,880,684 A 11/1989 Boss
4,909,909 A 3/1990 Florjancic
4,915,983 A 4/1990 Lake
4,969,979 A 11/1990 Appelt
4,975,142 A 12/1990 Iannacone
5,069,749 A 12/1991 Gutierrez
5,072,201 A 12/1991 Devaux
5,089,880 A 2/1992 Meyer
5,100,501 A 3/1992 Blumenthal
5,119,049 A 6/1992 Heller
5,191,699 A 3/1993 Ganslmeier
5,213,511 A 5/1993 Sobhani
5,227,013 A 7/1993 Kumar
5,235,208 A 8/1993 Katoh
5,274,484 A 12/1993 Mochizuki
5,299,939 A 4/1994 Walker
5,312,456 A 5/1994 Reed
5,334,956 A 8/1994 Leding
5,381,157 A 1/1995 Shiga
5,381,596 A * 1/1995 Ferro ..... H01P 11/002 216/19
5,406,235 A 4/1995 Hayashi
5,406,423 A 4/1995 Hayashi
5,430,257 A 7/1995 Lau
5,454,161 A 10/1995 Beilin
5,529,504 A 6/1996 Greenstein
5,622,895 A 4/1997 Frank
5,633,615 A 5/1997 Quan
5,682,062 A 10/1997 Gaul
5,682,124 A 10/1997 Suski
5,712,607 A 1/1998 Dittmer
5,724,012 A 3/1998 Teunisse
5,746,868 A 5/1998 Abe
5,793,272 A 8/1998 Burghartz
5,814,889 A 9/1998 Gaul
5,860,812 A 1/1999 Gugliotti
5,872,399 A 2/1999 Lee
5,903,059 A 5/1999 Bertin
5,925,206 A 7/1999 Boyko
5,940,674 A 8/1999 Sachs
5,961,347 A 10/1999 Hsu
5,977,842 A 11/1999 Brown
5,990,768 A 11/1999 Takahashi
6,008,102 A 12/1999 Alford
6,027,630 A 2/2000 Cohen
6,054,252 A 4/2000 Lundy
6,101,705 A 8/2000 Wolfson
6,160,454 A 12/2000 Buer et al.
6,180,261 B1 1/2001 Inoue
6,183,268 B1 2/2001 Consoli
6,207,901 B1 3/2001 Smith
6,210,221 B1 4/2001 Maury
6,228,466 B1 5/2001 Tsukada
6,232,669 B1 5/2001 Khoury
6,294,965 B1 9/2001 Merrill
6,329,605 B1 12/2001 Beroz
6,350,633 B1 2/2002 Lin
6,388,198 B1 5/2002 Bertin
6,457,979 B1 10/2002 Dove
6,465,747 B2 10/2002 DiStefano
6,466,112 B1 10/2002 Kwon
6,514,845 B1 2/2003 Eng
6,518,165 B1 2/2003 Yoon
6,535,088 B1 3/2003 Sherman
6,538,312 B1 3/2003 Peterson
6,589,594 B1 7/2003 Hembree
6,600,395 B1 7/2003 Handforth
6,603,376 B1 8/2003 Handforth
6,648,653 B2 11/2003 Huang
6,662,443 B2 12/2003 Chou
6,677,248 B2 1/2004 Kwon
6,735,009 B2 5/2004 Li
6,746,891 B2 6/2004 Cunningham
6,749,737 B2 6/2004 Cheng
6,800,360 B2 10/2004 Miyanaga
6,800,555 B2 10/2004 Test
6,827,608 B2 12/2004 Hall
6,850,084 B2 2/2005 Hembree
6,868,214 B1 * 3/2005 Sakata ..... G02B 6/138 385/129
6,888,427 B2 5/2005 Sinsheimer
6,889,433 B1 5/2005 Enomoto
6,914,513 B1 7/2005 Wahlers
6,917,086 B2 7/2005 Cunningham
6,943,452 B2 9/2005 Bertin
6,971,913 B1 12/2005 Chu

(56) References Cited

U.S. PATENT DOCUMENTS

| | | | |
|---|---|---|---|
| 6,975,267 | B2 | 12/2005 | Stenger |
| 6,981,414 | B2 | 1/2006 | Knowles |
| 7,005,750 | B2 | 2/2006 | Liu |
| 7,012,489 | B2 | 3/2006 | Sherrer |
| 7,030,712 | B2 | 4/2006 | Brunette |
| 7,064,449 | B2 | 6/2006 | Lin |
| 7,077,697 | B2 | 7/2006 | Kooiman |
| 7,084,722 | B2 | 8/2006 | Goyette |
| D530,674 | S | 10/2006 | Ko |
| 7,116,190 | B2 | 10/2006 | Brunker |
| 7,129,163 | B2 | 10/2006 | Sherrer |
| 7,148,141 | B2 | 12/2006 | Shim |
| 7,148,722 | B1 | 12/2006 | Cliff |
| 7,148,772 | B2 | 12/2006 | Sherrer |
| 7,165,974 | B2 | 1/2007 | Kooiman |
| 7,217,156 | B2 | 5/2007 | Wang |
| 7,222,420 | B2 | 5/2007 | Moriizumi |
| 7,239,219 | B2 | 7/2007 | Brown |
| 7,252,861 | B2 | 8/2007 | Smalley |
| 7,259,640 | B2 | 8/2007 | Brown |
| 7,383,632 | B2 | 6/2008 | Dittmann |
| 7,388,388 | B2 | 6/2008 | Dong |
| 7,400,222 | B2 | 7/2008 | Kwon |
| 7,405,638 | B2 | 7/2008 | Sherrer |
| 7,449,784 | B2 | 11/2008 | Sherrer |
| 7,478,475 | B2 | 1/2009 | Hall |
| 7,508,065 | B2 | 3/2009 | Sherrer |
| 7,532,163 | B2 | 5/2009 | Chang |
| 7,555,309 | B2 | 6/2009 | Baldor |
| 7,575,474 | B1 | 8/2009 | Dodson |
| 7,579,553 | B2 | 8/2009 | Moriizumi |
| 7,602,059 | B2 | 10/2009 | Nobutaka |
| 7,619,441 | B1 | 11/2009 | Rahman |
| 7,628,617 | B2 | 12/2009 | Brown |
| 7,645,147 | B2 | 1/2010 | Dittmann |
| 7,645,940 | B2 | 1/2010 | Shepherd |
| 7,649,432 | B2 | 1/2010 | Sherrer |
| 7,656,256 | B2 | 2/2010 | Houck |
| 7,658,831 | B2 | 2/2010 | Mathieu |
| 7,683,842 | B1 | 3/2010 | Engel |
| 7,705,456 | B2 | 4/2010 | Hu |
| 7,741,853 | B2 | 6/2010 | Blakely |
| 7,755,174 | B2 | 7/2010 | Rollin |
| 7,898,356 | B2 | 3/2011 | Sherrer |
| 7,948,335 | B2 | 5/2011 | Sherrer |
| 8,011,959 | B1 | 9/2011 | Tsai |
| 8,031,037 | B2 | 10/2011 | Sherrer |
| 8,188,932 | B2 | 5/2012 | Worl |
| 8,264,297 | B2 | 9/2012 | Thompson |
| 8,304,666 | B2 | 11/2012 | Ko |
| 8,339,232 | B2 | 12/2012 | Lotfi |
| 8,441,118 | B2 | 5/2013 | Hua |
| 8,522,430 | B2 | 9/2013 | Kacker |
| 8,542,079 | B2 | 9/2013 | Sherrer |
| 8,641,428 | B2 | 2/2014 | Light |
| 8,674,872 | B2 | 3/2014 | Billaud |
| 8,742,874 | B2 | 6/2014 | Sherrer |
| 8,814,601 | B1 | 8/2014 | Sherrer |
| 8,888,504 | B2 | 11/2014 | Pischler |
| 9,000,863 | B2 | 4/2015 | Sherrer |
| 9,306,254 | B1 | 4/2016 | Hovey |
| 9,325,044 | B2 | 4/2016 | Reid |
| 9,505,613 | B2 | 11/2016 | Sherrer |
| 9,536,843 | B2 * | 1/2017 | Takagi ..... H01P 5/107 |
| 9,583,856 | B2 | 2/2017 | Sherrer |
| 9,633,976 | B1 | 4/2017 | Bernstein |
| 9,888,600 | B2 | 2/2018 | Hovey |
| 2001/0040051 | A1 | 11/2001 | Lipponen |
| 2001/0045361 | A1 | 11/2001 | Boone |
| 2002/0074565 | A1 | 6/2002 | Flagan |
| 2002/0075104 | A1 | 6/2002 | Kwon |
| 2002/0127768 | A1 | 9/2002 | Badir |
| 2003/0029729 | A1 | 2/2003 | Cheng |
| 2003/0052755 | A1 | 3/2003 | Barnes |
| 2003/0117237 | A1 | 6/2003 | Niu |
| 2003/0221968 | A1 | 12/2003 | Cohen |
| 2003/0222738 | A1 | 12/2003 | Brown |
| 2004/0000701 | A1 | 1/2004 | White |
| 2004/0003524 | A1 | 1/2004 | Ha |
| 2004/0004061 | A1 | 1/2004 | Merdan |
| 2004/0007468 | A1 | 1/2004 | Cohen |
| 2004/0007470 | A1 | 1/2004 | Smalley |
| 2004/0038586 | A1 | 2/2004 | Hall |
| 2004/0076806 | A1 | 4/2004 | Miyanaga |
| 2004/0124961 | A1 | 7/2004 | Aoyagi |
| 2004/0196112 | A1 | 10/2004 | Welbon |
| 2004/0263290 | A1 | 12/2004 | Sherrer |
| 2005/0013977 | A1 | 1/2005 | Wong |
| 2005/0030124 | A1 | 2/2005 | Okamoto |
| 2005/0042932 | A1 | 2/2005 | Mok |
| 2005/0045484 | A1 | 3/2005 | Smalley |
| 2005/0156693 | A1 | 7/2005 | Dove |
| 2005/0230145 | A1 | 10/2005 | Ishii |
| 2005/0250253 | A1 | 11/2005 | Cheung |
| 2008/0191817 | A1 | 8/2008 | Sherrer |
| 2008/0197946 | A1 | 8/2008 | Houck |
| 2008/0199656 | A1 | 8/2008 | Nichols |
| 2008/0240656 | A1 | 10/2008 | Rollin |
| 2009/0004385 | A1 | 1/2009 | Blackwell |
| 2009/0051476 | A1 | 2/2009 | Tada |
| 2009/0154972 | A1 | 6/2009 | Tanaka |
| 2010/0007016 | A1 | 1/2010 | Oppermann |
| 2010/0015850 | A1 | 1/2010 | Stein |
| 2010/0109819 | A1 | 5/2010 | Houck |
| 2010/0225435 | A1 | 9/2010 | Li |
| 2010/0296252 | A1 | 11/2010 | Rollin |
| 2010/0323551 | A1 | 12/2010 | Eldridge |
| 2011/0123783 | A1 | 5/2011 | Sherrer |
| 2011/0123794 | A1 | 5/2011 | Hiller |
| 2011/0181376 | A1 | 7/2011 | Vanhille |
| 2011/0181377 | A1 | 7/2011 | Vanhille |
| 2011/0210807 | A1 | 9/2011 | Sherrer |
| 2011/0273241 | A1 | 11/2011 | Sherrer |
| 2012/0182703 | A1 | 7/2012 | Rendek, Jr. |
| 2012/0233849 | A1 | 9/2012 | Smeys |
| 2013/0050055 | A1 | 2/2013 | Paradiso |
| 2013/0127577 | A1 | 5/2013 | Lotfi |
| 2016/0054385 | A1 | 2/2016 | Suto |

FOREIGN PATENT DOCUMENTS

| | | | |
|---|---|---|---|
| EP | 0398019 | A1 | 11/1990 |
| EP | 0485831 | A1 | 5/1992 |
| EP | 0845831 | A2 | 6/1998 |
| EP | 0911903 | A2 | 4/1999 |
| FR | 2086327 | A1 | 12/1971 |
| GB | 2265754 | | 10/1993 |
| JP | H027587 | A | 1/1990 |
| JP | 3027587 | | 2/1991 |
| JP | H041710 | A | 1/1992 |
| JP | H0685510 | A | 3/1994 |
| JP | H06302964 | A | 10/1994 |
| JP | H07060844 | | 3/1995 |
| JP | H07235803 | | 9/1995 |
| JP | H10041710 | | 2/1998 |
| JP | 1998163711 | | 6/1998 |
| JP | 2002533954 | | 10/2002 |
| JP | 2003032007 | | 1/2003 |
| JP | 2003249731 | | 9/2003 |
| JP | 200667621 | | 3/2006 |
| JP | 2007253354 | | 10/2007 |
| JP | 2008211159 | | 9/2008 |
| JP | 2008283012 | | 11/2008 |
| JP | 2008307737 | | 12/2008 |
| TW | I244799 | | 12/2005 |
| WO | 0007218 | A2 | 2/2000 |
| WO | 0039854 | A1 | 7/2000 |
| WO | 0206152 | A2 | 1/2002 |
| WO | 02080279 | A1 | 10/2002 |
| WO | 2004004061 | | 1/2004 |
| WO | 2005112105 | | 11/2005 |

(56) References Cited

FOREIGN PATENT DOCUMENTS

| | | |
|---|---|---|
| WO | 2009013751 A2 | 1/2009 |
| WO | 2010111455 | 9/2010 |

OTHER PUBLICATIONS

"Shiffman phase shifters designed to work over a 15-45GHz range," phys.org, Mar. 2014. [online: http://phys.org/wire-news/156496085/schiffman-phase-shifters-designed-to-work-over-a-15-45ghz-range.html].

A. Boryssenko, J. Arroyo, R. Reid, M.S. Heimbeck, "Substrate free G-band Vivaldi antenna array design, fabrication and testing" 2014 IEEE International Conference on Infrared, Millimeter, and Terahertz Waves, Tucson, Sep. 2014.

A. Boryssenko, K. Vanhille, "300-GHz microfabricated waveguide slotted arrays" 2014 IEEE International Conference on Infrared, Millimeter, and Terahertz Waves, Tucson, Sep. 2014.

A.A. Immorlica Jr., R. Actis, D. Nair, K. Vanhille, C. Nichols, J.-M. Rollin, D. Fleming, R. Varghese, D. Sherrer, D. Filipovic, E. Cullens, N. Ehsan, and Z. Popovic, "Miniature 3D micromachined solid state amplifiers," in 2008 IEEE International Conference on Microwaves, Communications, Antennas, and Electronic Systems, Tel-Aviv, Israel, May 2008, pp. 1-7.

Ali Darwish et al.; Vertical Balun and Wilkinson Divider; 2002 IEEE MTT-S Digest; pp. 109-112. NPL_30.

B. Cannon, K. Vanhille, "Microfabricated Dual-Polarized, W-band Antenna Architecture for Scalable Line Array Feed," 2015 IEEE Antenna and Propagation Symposium, Vancouver, Canada, Jul. 2015.

Brown et al., 'A Low-Loss Ka-Band Filter in Rectangular Coax Made by Electrochemical Fabrication', submitted to Microwave and Wireless Components Letters, date unknown {downloaded from www.memgen.com, 2004). NPL_1.

Chance, G.I. et al., "A suspended-membrane balanced frequency doubler at 200GHz," 29th International Conference on Infrared and Millimeter Waves and Terahertz Electronics, pp. 321-322, Karlsrube, 2004.

Chwomnawang et al., 'On-chip 3D Air Core Micro-Inductor for High-Frequency Applications Using Deformation of Sacrificial Polymer', Proc. SPIE, vol. 4334, pp. 54-62, Mar. 2001. NPL_2.

Colantonio, P., et al., "High Efficiency RF and Microwave Solid State Power Amplifiers," pp. 380-395, 2009.

Cole, B.E., et al., Micromachined Pixel Arrays Integrated with CMOS for Infrared Applications, pp. 64-64 (2000). NPL_3.

D. Filipovic, G. Potvin, D. Fontaine, C. Nichols, Z. Popovic, S. Rondineau, M. Lukic, K. Vanhille, Y. Saito, D. Sherrer, W. Wilkins, E. Daniels, E. Adler, and J. Evans, "Integrated micro-coaxial Ka-band antenna and array," GomacTech 2007 Conference, Mar. 2007.

D. Filipovic, G. Potvin, D. Fontaine, Y. Saito, J.-M. Rollin, Z. Popovic, M. Lukic, K. Vanhille, C. Nichols, "Ã?Áμ-coaxial phased arrays for Ka-Band Communications," Antenna Applications Symposium, Monticello, IL, Sep. 2008, pp. 104-115.

D. Filipovic, Z. Popovic, K. Vanhille, M. Lukic, S. Rondineau, M. Buck, G. Potvin, D. Fontaine, C. Nichols, D. Sherrer, S. Zhou, W. Houck, D. Fleming, E. Daniel, W. Wilkins, V. Sokolov, E. Adler, and J. Evans, "Quasi-planar rectangular μ-coaxial structures for mm-wave applications," Proc. GomacTech., pp. 28-31, San Diego, Mar. 2006.

D. Sherrer, "Improving electronics' functional density," MICROmanufacturing, May/Jun. 2015, pp. 16-18.

D.S. Filipovic, M. Lukic, Y. Lee and D. Fontaine, "Monolithic rectangular coaxial lines and resonators with embedded dielectric support," IEEE Microwave and Wireless Components Letters, vol. 18, No. 11, pp. 740-742, 2008.

De Los Santos, H.J., Introduction to Microelectromechanical (MEM) Microwave Systems {pp. 4, 7-8, 13) (1999). NPL_4.

Derwent Abstract Translation of WO-2010-011911 A2 (published 2010).

Deyong C, et al., A Microstructure Semiconductor Thermocouple for Microwave Power Sensors, 1997 Asia Pacific Microwave Conference, pp. 917-919. NPL_5.

E. Cullens, "Microfabricated Broadband Components for Microwave Front Ends," Thesis, 2011.

E. Cullens, K. Vanhille, Z. Popovic, "Miniature bias-tee networks integrated in microcoaxial lines," in Proc. 40th European Microwave Conf., Paris, France, Sep. 2010, pp. 413-416.

E. Cullens, L. Ranzani, E. Grossman, Z. Popovic, "G-Band Frequency Steering Antenna Array Design and Measurements," Proceedings of the XXXth URSI General Assembly, Istanbul, Turkey, Aug. 2011.

E. Cullens, L. Ranzani, K. Vanhille, E. Grossman, N. Ehsan, Z. Popovic, "Micro-Fabricated 130-180 GHz frequency scanning waveguide arrays," IEEE Trans. Antennas Propag., Aug. 2012, vol. 60, No. 8, pp. 3647-3653.

Ehsan, N. et al., "Microcoaxial lines for active hybrid-monolithic circuits," 2009 IEEE MTT-S Int. Microwave.Symp. Boston, MA, Jun. 2009.

Ehsan, N., "Broadband Microwave Litographic 3D Components," Doctoral Dissertation 2010.

Elliott Brown/MEMGen Corporation, 'RF Applications of EFAB Technology', MTT-S IMS 2003, pp. 1-15. NPL_6.

Engelmann et al., 'Fabrication of High Depth-to-Width Aspect Ratio Microstructures', IEEE Micro Electro Mechanical Systems (Feb. 1992), pp. 93-98.

European Examination Report dated Mar. 21, 2013 for EP Application No. 07150463.3.

European Examination Report of corresponding European Patent Application No. 08 15 3144 dated Apr. 6, 2010.

European Examination Report of corresponding European Patent Application No. 08 15 3144 dated Feb. 22, 2012.

European Examination Report of corresponding European Patent Application No. 08 15 3144 dated Nov. 10, 2008.

European Examination Report of EP App. No. 07150463.3 dated Feb. 16, 2015.

European Search Report for corresponding EP Application No. 071504633 dated Apr. 23, 2012.

European Search Report of corresponding European Application No. 08 15 3138 dated Jul. 15, 2008.

European Search Report of Corresponding European Application No. 07 15 0467 dated Apr. 28, 2008.

European Search Report of corresponding European Patent Application No. 08 15 3144 dated Jul. 2, 2008.

Extended EP Search Report for EP Application No. 12811132.5 dated Feb. 5, 2016.

Filipovic et al.; 'Modeling, Design, Fabrication, and Performance of Rectangular .mu.-Coaxial Lines and Components'; Microwave Symposium Digest, 2006, IEEE; Jun. 1, 2006; pp. 1393-1396.

Filipovic, D. et al., "Monolithic rectangular coaxial lines. Components and systems for commercial and defense applications," Presented at 2008 IASTED Antennas, Radar, and Wave Propagation Conferences, Baltimore, MD, USA, Apr. 2008.

Filipovic, D.S. "Design of microfabricated rectangular coaxial lines and components for mm-wave applications," Microwave Review, vol. 12, No. 2, Nov. 2006, pp. 11-16.

Franssila, S., Introduction to Microfabrication, (pp. 8) (2004). NPL_7.

Frazier et al., 'M ET ALlic Microstructures Fabricated Using Photosensitive Polyimide Electroplating Molds', Journal of Microelectromechanical Systems, vol. 2, No. 2, Jun. 1993, pp. 87-94. NPL_8.

Ghodisian, B., et al., Fabrication of Affordable M ET ALlic Microstructures by Electroplating and Photoresist Molds, 1996, pp. 68-71. NPL_9.

H. Guckel, 'High-Aspect-Ratio Micromachining Via Deep X-Ray Lithography', Proc. Of IEEE, vol. 86, No. 8 (Aug. 1998), pp. 1586-1593. NPL_10.

H. Kazemi, "350mW G-band Medium Power Amplifier Fabricated Through a New Method of 3D-Copper Additive Manufacturing," IEEE 2015.

(56) References Cited

OTHER PUBLICATIONS

H. Kazemi, "Ultra-compact G-band 16way Power Splitter/Combiner Module Fabricated Through a New Method of 3D-Copper Additive Manufacturing," IEEE 2015.
H. Zhou, N. A. Sutton, D. S. Filipovic, "Surface micromachined millimeter-wave log-periodic dipole array antennas," IEEE Trans. Antennas Propag., Oct. 2012, vol. 60, No. 10, pp. 4573-4581.
H. Zhou, N. A. Sutton, D. S. Filipovic, "Wideband W-band patch antenna," 5th European Conference on Antennas and Propagation , Rome, Italy, Apr. 2011, pp. 1518-1521.
Yoon et al., '3-D Lithography and M et al Surface Micromachining for RF and Microwave MEMs' IEEE MEMS 2002 Conference, Las Vegas, NV, Jan. 2002, pp. 673-676. NPL_21.
Yoon et al., 'CMOS-Compatible Surface Micromachined Suspended-Spiral Inductors for Multi-GHz Sillicon RF Ics', IEEE Electron Device Letters, vol. 23, No. 10, Oct. 2002, pp. 591-593. NPL_22.
Yoon et al., 'High-Performance Electroplated Solenoid-Type Integrated Inductor (SI2) for RF Applications Using Simple 3D Surface Micromachining Technology', Int'l Election Devices Meeting, 1998, San Francisco, CA, Dec. 6-9, 1998, pp. 544-547. NPL_23.
Yoon et al., 'High-Performance Three-Dimensional On-Chip Inductors Fabricated by Novel Micromachining Technology for RF MMIC', 1999 IEEE MTT-S Int'l Microwave Symposium Digest, vol. 4, Jun. 13-19, 1999, Anaheim, California, pp. 1523-1526. NPL_24.
Yoon et al., 'Monolithic High-Q Overhang Inductors Fabricated on Silicon and Glass Substrates', International Electron Devices Meeting, Washington D.C. (Dec. 1999), pp. 753-756. NPL_25.
Yoon et al., 'Monolithic Integration of 3-D Electroplated Microstructures with Unlimited Number of Levels Using Planarization with a Sacrificial M ET ALlic Mole (PSMm)', Twelfth IEEE Int'l Conf. on Micro Electro mechanical systems, Orlando Florida, Jan. 1999, pp. 624-629. NPL_26.
Yoon et al., 'Multilevel Microstructure Fabrication Using Single-Step 3D Photolithography and Single-Step Electroplating', Proc. Of SPIE, vol. 3512, (Sep. 1998), pp. 358-366. NPL_27.
Yoon et al., "High-Performance Electroplated Solenoid-Type Integrated Inductor (S12) for RF Applications Using Simple 3D Surface Micromachining Technology", Int'l Election Devices Meeting, 1998, San Francisco, CA, Dec. 6-9, 1998, pp. 544-547.
Z. Popovic, "Micro-coaxial micro-fabricated feeds for phased array antennas," in IEEE Int. Symp. on Phased Array Systems and Technology, Waltham, MA, Oct. 2010, pp. 1-10. (Invited).
Z. Popovic, K. Vanhille, N. Ehsan, E. Cullens, Y. Saito, J.-M. Rollin, C. Nichols, D. Sherrer, D. Fontaine, D. Filipovic, "Micro-fabricated micro-coaxial millimeter-wave components," in 2008 Int. Conf. on Infrared, Millimeter and Terahertz Waves, Pasadena, CA, Sep. 2008, pp. 1-3.
Z. Popovic, S. Rondineau, D. Filipovic, D. Sherrer, C. Nichols, J.-M. Rollin, and K. Vanhille, "An enabling new 3D architecture for microwave components and systems," Microwave Journal, Feb. 2008, pp. 66-86.
Mruk, J.R., Saito, Y., Kim, K, Radway, M., Filipovic, D.S., "Directly fed millimetre-wave two-arm spiral antenna," Electronics Letters, Nov. 25, 2010, vol. 46 , issue 24, pp. 1585-1587.
N. Chamberlain, M. Sanchez Barbetty, G. Sadowy, E. Long, K. Vanhille, "A dual-polarized metal patch antenna element for phased array applications," 2014 IEEE Antenna and Propagation Symposium, Memphis, Jul. 2014. pp. 1640-1641.
N. Ehsan, "Broadband Microwave Lithographic 3D Components," Thesis, 2009.
N. Ehsan, K. Vanhille, S. Rondineau, E. Cullens, Z. Popovic, "Broadband Wilkinson Dividers," IEEE Trans. Microwave Theory Tech., Nov. 2009, pp. 2783-2789.
N. Ehsan, K.J. Vanhille, S. Rondineau, Z. Popovic, "Micro-coaxial impedance transformers," IEEE Trans. Microwave Theory Tech., Nov. 2010, pp. 2908-2914.
N. Jastram, "Design of a Wideband Millimeter Wave Micromachined Rotman Lens," IEEE Transactions on Antennas and Propagation, vol. 63, No. 6, Jun. 2015.
N. Jastram, "Wideband Millimeter-Wave Surface Micromachined Tapered Slot Antenna," IEEE Antennas and Wireless Propagation Letters, vol. 13, 2014.
N. Jastram, "Wideband Multibeam Millimeter Wave Arrays," IEEE 2014.
N. Jastram, D. Filipovic, "Monolithically integrated K/Ka array-based direction finding subsystem," Proc. IEEE-APS/URSI Symposium, Chicago, IL, Jul. 2012, pp. 1-2.
N. Jastram, D. S. Filipovic, "Parameter study and design of W-band micromachined tapered slot antenna," Proc. IEEE-APS/URSI Symposium, Orlando, FL, Jul. 2013, pp. 434-435.
N. Jastram, D. S. Filipovic, "PCB-based prototyping of 3-D micromachined RF subsystems," IEEE Trans. Antennas Propag., vol. 62, No. 1, Jan. 2014. pp. 420-429.
N. Sutton, D.S. Filipovic, "Design of a K-thru Ka-band modified Butler matrix feed for a 4-arm spiral antenna," 2010 Loughborough Antennas and Propagation Conference, Loughborough, UK, Nov. 2010, pp. 521-524.
N.A. Sutton, D. S. Filipovic, "V-band monolithically integrated four-arm spiral antenna and beamforming network," Proc. IEEE-APS/URSI Symposium, Chicago, IL, Jul. 2012, pp. 1-2.
N.A. Sutton, J. M. Oliver, D. S. Filipovic, "Wideband 15-50 GHz symmetric multi-section coupled line quadrature hybrid based on surface micromachining technology," 2012 IEEE MTT-S Int. Microwave, Symp., Montreal, Canada, Jun. 2012.
N.A. Sutton, J.M. Oliver, D.S. Filipovic, "Wideband 18-40 GHz surface micromachined branchline quadrature hybrid," IEEE Microwave and Wireless Components Letters, Sep. 2012, vol. 22, No. 9, pp. 462-464.
Oliver, J.M. et al., "A 3-D micromachined W-band cavity backed patch antenna array with integrated rectacoax transition to wave guide," 2009 Proc. IEEE International Microwave Symposium, Boston, MA 2009.
P. Ralston, K. Vanhille, A. Caba, M. Oliver, S. Raman, "Test and verification of micro coaxial line power performance," 2012 IEEE MTT-S Int. Microwave, Symp., Montreal, Canada, Jun. 2012.
P. Ralston, M. Oliver, K. Vummidi, S. Raman, "Liquid-metal vertical interconnects for flip chip assembly of GaAs C-band power amplifiers onto micro-rectangular coaxial transmission lines," IEEE Compound Semiconductor Integrated Circuit Symposium, Oct. 2011.
P. Ralston, M. Oliver, K. Vummidi, S. Raman, "Liquid-metal vertical interconnects for flip chip assembly of GaAs C-band power amplifiers onto micro-rectangular coaxial transmission lines," IEEE Journal of Solid-State Circuits, Oct. 2012, vol. 47, No. 10, pp. 2327-2334.
Park et al., 'Electroplated Micro-Inductors and Micro-Transformers for Wireless application', IMAPS 2002, Denver, CO, Sep. 2002. NPL_18.
PwrSoC Update 2012: Technology, Challenges, and Opportunities for Power Supply on Chip, Presentation (Mar. 18, 2013).
Rollin, J.M. et al., "A membrane planar diode for 200GHz mixing applications," 29th International Conference on Infrared and Millimeter Waves and Terahertz Electronics, pp. 205-206, Karlsrube, 2004.
Rollin, J.M. et al., "Integrated Schottky diode for a sub-harmonic mixer at millimetre wavelengths," 31st International Conference on Infrared and Millimeter Waves and Terahertz Electronics, Paris, 2006.
S. Huettner, "High Performance 3D Micro-Coax Technology," Microwave Journal, Nov. 2013. [online: http://www.microwavejournal.com/articles/21004-high-performance-3d-micro-coax-technology].
S. Huettner, "Transmission lines withstand vibration," Microwaves and RF, Mar. 2011. [online: http://mwrf.com/passive-components/transmission-lines-withstand-vibration].
S. Scholl, C. Gorle, F. Houshmand, T. Liu, H. Lee, Y. Won, H. Kazemi, M. Asheghi, K. Goodson, "Numerical Simulation of Advanced Monolithic Microcooler Designs for High Heat Flux Microelectronics," InterPACK, San Francisco, CA, Jul. 2015.
S. Scholl, C. Gorle, F. Houshmand, T. Verstraete, M. Asheghi, K. Goodson, "Optimization of a microchannel geometry for cooling high heat flux microelectronics using numerical methods," InterPACK, San Francisco, CA, Jul. 2015.

(56) References Cited

OTHER PUBLICATIONS

Saito et al., "Analysis and design of monolithic rectangular coaxial lines for minimum coupling," IEEE Trans. Microwave Theory Tech., vol. 55, pp. 2521-2530, Dec. 2007.
Saito, Y., Fontaine, D., Rollin, J-M., Filipovic, D., 'Micro-Coaxial Ka-Band Gysel Power Dividers,' Microwave Opt Technol Lett 52: 474-478, 2010, Feb. 2010.
Sedky, S., Post-Processing Techniques for Integrated MEMS (pp. 9, 11, 164) (2006). NPL_19.
Sheffer, D, Vanhille, K, Rollin, J.M., 'PolyStrata Technology: A Disruptive Approach for 3D Microwave Components and Modules,' Presentation (Apr. 23, 2010).
T. Durham, H.P. Marshall, L. Tsang, P. Racette, Q. Bonds, F. Miranda, K. Vanhille, "Wideband sensor technologies for measuring surface snow," Earthzine, Dec. 2013, [online: http://www.earthzine.org/2013/12/02/wideband-sensor-technologies-for-measuring-surface-snow/].
T. E. Durham, C. Trent, K. Vanhille, K. M. Lambert, F. A. Miranda, "Design of an 8-40 GHz Antenna for the Wideband Instrument for Snow Measurements (WISM)," 2015 IEEE Antenna and Propagation Symposium, Vancouver, Canada, Jul. 2015.
T. Liu, F. Houshmand, C. Gorle, S. Scholl, H. Lee, Y. Won, H. Kazemi, K. Vanhille, M. Asheghi, K. Goodson, "Full-Scale Simulation of an Integrated Monolithic Heat Sink for Thermal Management of a High Power Density GaN-SiC Chip," InterPACK/ICNMM, San Francisco, CA, Jul. 2015.
T.E. Durham, "An 8-40GHz Wideband Instrument for Snow Measurements," Earth Science Technology Forum, Pasadena, CA, Jun. 2011.
Tian, et al.; Fabrication of multilayered SU8 structure for terahertz waveguide with ultralow transmission loss; Aug. 18, 2013; Dec. 10, 2013; pp. 13002-1 to 13002-6.
Tummala et al.; 'Microelectronics Packaging Handbook'; Jan. 1, 1989; XP002477031; pp. 710-714. NPL_31.
Vanhille, K. et al., 'Balanced low-loss Ka-band-coaxial hybrids,' IEEE MTT-S Dig., Honolulu, Hawaii, Jun. 2007.
Vanhille, K. et al., "Ka-Band surface mount directional coupler fabricated using micro-rectangular coaxial transmission lines," 2008 Proc. IEEE International Microwave Symposium, 2008.
Vanhille, K., 'Design and Characterization of Microfabricated Three-Dimensional Millimeter-Wave Components,' Dissertation, 2007.
Vanhille, K.J. et al., "Ka-band miniaturized quasi-planar high-Q resonators," IEEE Trans. Microwave Theory Tech., vol. 55, No. 6, pp. 1272-1279, Jun. 2007.
Vyas R. et al., "Liquid Crystal Polymer (LCP): The ultimate solution for low-cost RF flexible electronics and antennas," Antennas and Propagation Society, International Symposium, p. 1729-1732 (2007).
Wang, H. et al., "Design of a low integrated sub-harmonic mixer at 183GHz using European Schottky diode technology," From Proceedings of the 4th ESA workshop on Millimetre-Wave Technology and Applications, pp. 249-252, Espoo, Finland, Feb. 2006.
Wang, H. et al., "Power-amplifier modules covering 70-113 GHz using MMICs," IEEE Trans Microwave Theory and Tech., vol. 39, pp. 9-16, Jan. 2001.
Written Opinion corresponding to PCT/US12/46734 dated Nov. 20, 2012.
Written Opinion of the International Searching Authority dated Aug. 29, 2005 on corresponding PCT/US04/06665.
Y. Saito, D. Fontaine, J.-M. Rollin, D.S. Filipovic, "Monolithic micro-coaxial power dividers," Electronic Letts., Apr. 2009, pp. 469-470.
Y. Saito, J.R. Mruk, J.-M. Rollin, D.S. Filipovic, "X-through Q-band log-periodic antenna with monolithically integrated u-coaxial impedance transformer/feeder," Electronic Letts. Jul. 2009, pp. 775-776.
Y. Saito, M.V. Lukic, D. Fontaine, J.-M. Rollin, D.S. Filipovic, "Monolithically Integrated Corporate-Fed Cavity-Backed Antennas," IEEE Trans. Antennas Propag., vol. 57, No. 9, Sep. 2009, pp. 2583-2590.
Yeh, J.L., et al., Copper-Encapsulated Silicon Micromachined Structures, Journal of Microelectromechanical Systems, vol. 9, No. 3, Sep. 2000, pp. 281-287. NPL_20.
H. Zhou, N.A. Sutton, D. S. Filipovic, "W-band endfire log periodic dipole array," Proc. IEEE-APS/URSI Symposium, Spokane, WA, Jul. 2011, pp. 1233-1236.
Hawkins, C.F., The Microelectronics Failure Analysis, Desk Reference Edition (2004). NPL_11.
Horton, M.C., et al., "The Digital Elliptic Filter—A Compact Sharp-Cutoff Design for Wide Bandstop or Bandpass Requirements," IEEE Transactions on Microwave Theory and Techniques, (1967) MTT-15:307-314.
Immorlica, Jr., T. et al., "Miniature 3D micro-machined solid state power amplifiers," COMCAS 2008.
Ingram, D.L. et al., "A 427 mW 20% compact W-band InP HEMT MMIC power amplifier," IEEE RFIC Symp. Digest 1999, pp. 95-98.
International Preliminary Report on Patentability dated Jul. 24, 2012 for corresponding PCT/US2011/022173.
International Preliminary Report on Patentability dated May 19, 2006 on corresponding PCT/US04/06665.
International Search Report and Written Opinion for PCT/US2015/011789 dated Apr. 10, 2015.
International Search Report and Written Opinion for PCT/US2015/063192 dated May 20, 2016.
International Search Report corresponding to PCT/US12/46734 dated Nov. 20, 2012.
International Search Report dated Aug. 29, 2005 on corresponding PCT/US04/06665.
J. M. Oliver, J.-M. Rollin, K. Vanhille, S. Raman, "A W-band micromachined 3-D cavity-backed patch antenna array with integrated diode detector," IEEE Trans. Microwave Theory Tech., Feb. 2012, vol. 60, No. 2, pp. 284-292.
J. M. Oliver, P. E. Ralston, E. Cullens, L. M. Ranzani, S. Raman, K. Vanhille, "A W-band Micro-coaxial Passive Monopulse Comparator Network with Integrated Cavity-Backed Patch Antenna Array," 2011 IEEE MTT-S Int. Microwave, Symp., Baltimore, MD, Jun. 2011.
J. Mruk, "Wideband Monolithically Integrated Front-End Subsystems and Components," Thesis, 2011.
J. Mruk, Z. Hongyu, M. Uhm, Y. Saito, D. Filipovic, "Wideband mm-Wave Log-Periodic Antennas," 3rd European Conference on Antennas and Propagation, pp. 2284-2287, Mar. 2009.
J. Oliver, "3D Micromachined Passive Components and Active Circuit Integration for Millimeter-Wave Radar Applications," Thesis, Feb. 10, 2011.
J. R. Mruk, H. Zhou, H. Levitt, D. Filipovic, "Dual wideband monolithically integrated millimeter-wave passive front-end subsystems," in 2010 Int. Conf. on Infrared, Millimeter and Terahertz Waves , Sep. 2010, pp. 1-2.
J. R. Mruk, N. Sutton, D. S. Filipovic, "Micro-coaxial fed 18 to 110 GHz planar log-periodic antennas with RF transitions," IEEE Trans. Antennas Propag., vol. 62, No. 2, Feb. 2014, pp. 968-972.
J. Reid, "PolyStrata Millimeter-wave Tunable Filters," GOMACTech-12, Mar. 22, 2012.
J.M. Oliver, H. Kazemi, J.-M. Rollin, D. Sherrer, S. Huettner, S. Raman, "Compact, low-loss, micromachined rectangular coaxial millimeter-wave power combining networks," 2013 IEEE MTT-S Int. Microwave, Symp., Seattle, WA, Jun. 2013.
J.R. Mruk, Y. Saito, K. Kim, M. Radway, D. Filipovic, "A directly fed Ku-to W-band 2-arm Archimedean spiral antenna," Proc. 41st European Microwave Conf., Oct. 2011, pp. 539-542.
J.R. Reid, D. Hanna, R.T. Webster, "A 40/50 GHz diplexer realized with three dimensional copper micromachining," in 2008 IEEE MTT-S Int. Microwave Symp., Atlanta, GA, Jun. 2008, pp. 1271-1274.
J.R. Reid, J.M. Oliver, K. Vanhille, D. Sherrer, "Three dimensional metal micromachining: A disruptive technology for millimeter-wave filters," 2012 IEEE Topical Meeting on Silicon Monolithic Integrated Circuits in RF Systems, Jan. 2012.
Jeong, I., et al., "High Performance Air-Gap Transmission Lines and Inductors for Milimeter-Wave Applications", Transactions on Microwave Theory and Techniques, vol. 50, No. 12, Dec. 2002.

(56) References Cited

OTHER PUBLICATIONS

Jeong, Inho et al., 'High-Performance Air-Gap Transmission Lines and Inductors for Millimeter-Wave Applications', IEEE Transactions on Microwave Theory and Techniques, Dec. 2002, pp. 2850-2855, vol. 50, No. 12. NPL_12.
K. J. Vanhille, D. L. Fontaine, C. Nichols, D. S. Filipovic, and Z. Popovic, "Quasi-planar high-Q millimeter-wave resonators," IEEE Trans. Microwave Theory Tech., vol. 54, No. 6, pp. 2439-2446, Jun. 2006.
K. M. Lambert, F. A. Miranda, R. R. Romanofsky, T. E. Durham, K. J. Vanhille, "Antenna characterization for the Wideband Instrument for Snow Measurements (WISM)," 2015 IEEE Antenna and Propagation Symposium, Vancouver, Canada, Jul. 2015.
K. Vanhille, "Design and Characterization of Microfabricated Three-Dimensional Millimeter-Wave Components," Thesis, 2007.
K. Vanhille, M. Buck, Z. Popovic, and D.S. Filipovic, "Miniature Ka-band recta-coax components: analysis and design," presented at 2005 AP-S/URSI Symposium, Washington, DC, Jul. 2005.
K. Vanhille, M. Lukic, S. Rondineau, D. Filipovic, and Z. Popovic, "Integrated micro-coaxial passive components for millimeter-wave antenna front ends," 2007 Antennas, Radar, and Wave Propagation Conference, May 2007.
K. Vanhille, T. Durham, W. Stacy, D. Karasiewicz, A. Caba, C. Trent, K. Lambert, F. Miranda, "A microfabricated 8-40 GHz dual-polarized reflector feed," 2014 Antenna Applications Symposium, Monticello, IL, Sep. 2014. pp. 241-257.
Katehi et al., 'MEMS and Si Micromachined Circuits for High-Frequency Applications', IEEE Transactions on Microwave Theory and Techniques, vol. 50, No. 3, Mar. 2002, pp. 858-866. NPL_13.
Kenneth J. Vanhille et al.; Micro-Coaxial Imedance Transformers; Journal of Latex Class Files; vol. 6; No. 1; Jan. 2007. NPL_29.
Kwok, P.Y., et al., Fluid Effects in Vibrating Micromachined Structures, Journal of Microelectromechanical Systems, vol. 14, No. 4, Aug. 2005, pp. 770-781. NPL_14.
L. Ranzani, D. Kuester, K. J. Vanhille, A Boryssenko, E. Grossman, Z. Popovic, "G-Band micro-fabricated frequency-steered arrays with 2Â?Â°/GHz beam steering," IEEE Trans. on Terahertz Science and Technology, vol. 3, No. 5, Sep. 2013.
L. Ranzani, E. D. Cullens, D. Kuester, K. J. Vanhille, E. Grossman, Z. Popovic, "W-band micro-fabricated coaxially-fed frequency scanned slot arrays," IEEE Trans. Antennas Propag., vol. 61, No. 4, Apr. 2013.
L. Ranzani, I. Ramos, Z. Popovic, D. Maksimovic, "Microfabricated transmission-line transformers with DC isolation," URSI National Radio Science Meeting, Boulder, CO, Jan. 2014.
L. Ranzani, N. Ehsan, Z. Popovic, "G-band frequency-scanned antenna arrays," 2010 IEEE APS-URSI International Symposium, Toronto, Canada, Jul. 2010.
Lee et al., 'Micromachining Applications of a High Resolution Ultrathick Photoresist', J. Vac. Sci. Technol. B 13 (6), Nov./Dec. 1995, pp. 3012-3016. NPL_15.
Loechel et al., 'Application of Ultraviolet Depth Lithography for Surface Micromachining', J. Vac. Sci. Technol. B 13 (6), Nov./Dec. 1995, pp. 2934-2939. NPL_16.
Lukic, M. et al., "Surface-micromachined dual Ka-band cavity backed patch antennas," IEEE Trans. AtennasPropag., vol. 55, pp. 2107-2110, Jul. 2007.
M. Lukic, D. Filipovic, "Modeling of surface roughness effects on the performance of rectangular Â?Âµ-coaxial lines," Proc. 22nd Ann. Rev. Prog. Applied Comp. Electromag. (ACES), pp. 620-625, Miami, Mar. 2006.
M. Lukic, D. Fontaine, C. Nichols, D. Filipovic, "Surface micromachined Ka-band phased array antenna," Presented at Antenna Applic. Symposium, Monticello, IL, Sep. 2006.
M. Lukic, K. Kim, Y. Lee, Y. Saito, and D. S. Filipovic, "Multi-physics design and performance of a surface micromachined Ka-band cavity backed patch antenna," 2007 SBMO/IEEE Int. Microwave and Optoelectronics Conf., Oct. 2007, pp. 321-324.
M. Lukic, S. Rondineau, Z. Popovic, D. Filipovic, "Modeling of realistic rectangular Â?Âµ-coaxial lines," IEEE Trans. Microwave Theory Tech., vol. 54, No. 5, pp. 2068-2076, May 2006.
M. V. Lukic, and D. S. Filipovic, "Integrated cavity-backed ka-band phased array antenna," Proc. IEEE-APS/URSI Symposium, Jun. 2007, pp. 133-135.
M. V. Lukic, and D. S. Filipovic, "Modeling of 3-D Surface Roughness Effects With Application to Â?Âµ-Coaxial Lines," IEEE Trans. Microwave Theory Tech., Mar. 2007, pp. 518-525.
M. V. Lukic, and D. S. Filipovic, "Surface-micromachined dual Ka- and cavity backed patch antenna," IEEE Trans. Antennas Propag., vol. 55, No. 7, pp. 2107-2110, Jul. 2007.
Madou, M.J., Fundamentals of Microfabrication: The Science of Miniaturization, 2d Ed., 2002 (Roadmap; pp. 615-668). NPL_17.
Mruk, J.R., Filipovic, D.S, "Micro-coaxial V-/W-band filters and contiguous diplexers," Microwaves, Antennas & Propagation, IET, Jul. 17, 2012, vol. 6, issue 10, pp. 1142-1148.

* cited by examiner 400
4A
310
314
416
146
302
131
145
135
424
312

SYSTEMS AND METHODS FOR MANUFACTURING STACKED CIRCUITS AND TRANSMISSION LINES

RELATED APPLICATIONS

This application is a 371 application of International Application No. PCT/US2015/063192 filed Dec. 1, 2015, which claims the benefit of priority of 62/086,939 filed Dec. 3, 2014. Each of the foregoing applications is hereby incorporated herein by reference.

GOVERNMENT LICENSE RIGHTS

The subject matter of the present application was made with government support from the Defense Advanced Research Projects Agency under contract number FA8650-14-C-7468. The government may have certain rights to the subject matter of the present application.

FIELD OF THE INVENTION

The present invention relates to microwave and millimeter wave components circuits and systems, and more particularly, but not exclusively to stacked circuits and transmission lines and methods for the manufacture thereof.

BACKGROUND OF THE INVENTION

Passive and active RF components are integral to microwave and millimeter wave systems. Generally these components are designed based on the manufacturing methods and tolerances within the build process. Traditionally such processes include a computer numerically controlled (CNC) machine process or a die-cast process depending on the volume of the waveguide components to be made. These methods can suffer from multiple deficiencies such as the method of manufacturing being serial and not batch processed. For example, for CNC, the geometry of each machined part needs to be programmed into the machine for the build, and tolerances of the build depend on the tool cutters and temperature of the machine which can vary substantially. In addition, to achieve high resolution and accurate parts, the machine speed is often lowered and operated by a skilled machinist, increasing the overall cost. For die-cast processes, the resolution that can be achieved is often much coarser than the designs require, and unacceptable variation from die to die can reduce overall yield. Multiple part assemblies can also be complex and add to further errors in positional accuracy of pins, dowels, and features. The above drawbacks contribute to the high cost of passive and active microwave and millimeter wave components and modules, with recent years showing little improvement in the overall build process.

Planar circuits are alternative structures which can include microwave printed circuit boards with dielectrically loaded microstrip or coplanar structures. However, drawbacks for these circuits include insertion loss and lack of isolation between signal lines compromising signal integrity.

Another major drawback with both 3D machining and planar circuits is the lack of compactness or functional density. The machining of transmission lines such as waveguide channels are only performed in 2D surfaces in split waveguide formations. This limits the full 3D functionality where the active elements can only be placed in specific locations dictated by machining orientation. In planar circuits, a limitation of 3D multilayer parts includes poor thermal management due to high dielectric load between the interconnects and lack of inclusion of active elements such as integrated circuits in embedded architectures. Furthermore, planar multilayer circuits are heavy and can become a large burden for the overall system.

Millimeter-wave and THz waveguide structures made from cross-linked photoresist SU-8 are disclosed in Tian, Y, Shang, X & Lancaster, M J 2014, "Fabrication of multilayered SU8 structure for terahertz waveguide with ultralow transmission loss," Journal of Micro/Nanolithography, MEMS, and MOEMS, vol 13, no. 1, 013002.,10.1117/1.JMM.13.1.013002, hereafter "Tian." Such an approach is limited both in the process capability and the resulting structures. Metallizing a photoresist using methods such as electroless plating to create a sliced waveguide structure has many limitations.

A first limitation in the art is that a photoresist plastic such as SU-8 has very low thermal conductivity, so the electronic chips cannot dissipate the heat they generate through the plastic. A second is that a thin metal on plastic has a CTE mismatch preventing such structures from surviving the thermal cycles needed for consumer, industrial, and aerospace applications. A third is that such plastic structures and metallized plastic are not compatible with standard chip interconnect processes such as wirebonding. A fourth is that fusing metallized layers of plastic is difficult due to the inability for such structures to endure substantial mechanical compression without delamination, cracking, and peeling of the metal coatings on the plastic. A fifth limitation is the mechanical robustness of a stacked plastic part particularly when thin or small intricate features are required. A sixth limitation is the poor resolution offered after metallization of patterned plastic parts. In some cases, one might try electroplating rather than electroless plating on the plastic. As the parts are metal seeded and electroplated, current crowding effects unevenly electroplate the structure depending on the locations on the part exposed to the electroplating anode. This is even a larger problem for thicker electroplating in excess of 3 μm which would be required for mechanical strength of the parts. A seventh limitation is the accurate alignment of multi-stacking of parts due to the above (sixth limitation) over-plating of corners and edges. An eighth limitation is the overall number of stacks and their ordering and available features that can be created or used in a single monolithic plastic part. As each layer is added on top of a cured and exposed lower layer, it is chemically attacked throughout the fabrication process which will affect the interfaces between each layer causing delamination and poor adhesion. In addition, and more limiting in this eighth limitation, is that when attempting more than one layer of photoplastic in a monolithic construction, any added layer's photoexposure must fall inside the planar area of the previous layer's photoexposure so that the previous layer is not inadvertently photoexposed in an undesired region. A ninth limitation is the mechanical robustness of the metalized-plastic parts. For example, as the individual parts come together quite often mechanical screws are used to fixture parts and force the layers together for a no-gap connection. The metalized plastic parts cannot be tapped for a screw or pressed hard against each other for a firm contact. A tenth limitation is the lack of combined plastic (or non-conductor) and metal (or conductor) on the same integrated layer, which can be needed to isolate transmission lines from each other electrically and is an important attribute as the layers become more functionally capable. Thus, due to these limitations and more, there remains a need in the art for devices and methods that can achieve the above requirements while overcoming the limitations currently present in the art.

SUMMARY OF THE INVENTION

In one of its aspects the present invention may provide a stacked waveguide structure comprising a plurality of metal waveguide slices, which may be solid metal. Each waveguide slice may include at least one waveguide cavity disposed therein. Selected pairs of the waveguide slices may be disposed adjacent one another, with the waveguide cavity of each slice of a selected pair registered to one another so the waveguide cavities of the selected pair of slices communicate with one another to provide at least one waveguide within the stacked waveguide structure. The waveguide cavity of a selected slice may extend through the depth of the slice to provide openings on opposing surfaces of the slice or may extend partially into the depth of the slice. A selected slice may include two waveguide cavities oriented orthogonal to one another within the slice. Further, a selected pair of waveguide slices may each have a face disposed adjacent one another, with at least a portion of a waveguide disposed orthogonal to, or parallel to, the faces. The at least one waveguide may include a waveguide splitter and/or waveguide combiner. A plurality of waveguides may be provided in the stacked waveguide structure which do not communicate with one another.

In another of its aspects, the stacked waveguide structure may include an integrated circuit chip disposed in electromagnetic communication with a waveguide input and/or a waveguide output of the stacked waveguide structure. In addition, a waveguide transition may be provided between the integrated circuit chip and the waveguide input and output; the transition may include a waveguide cavity therein disposed in electromagnetic communication with the waveguide output. The transition may also include a probe disposed within the waveguide cavity of the transition, with the probe configured to convert electromagnetic energy disposed within the waveguide cavity of the transition into electrical energy within the probe. The probe may be disposed in electrical communication with the integrated circuit chip.

In yet a further of its aspects, the present invention may provide a method of creating a stacked waveguide structure, comprising depositing a plurality of layers on a substrate. The layers may include one or more of a metal material and a sacrificial mold material, thereby forming a plurality of solid metal waveguide slices each having at least one waveguide cavity disposed therein. The method may include the step of aligning and joining the plurality of waveguide slices to one another so the waveguide cavities of the slices communicate with one another to provide at least one waveguide within the stacked waveguide structure.

BRIEF DESCRIPTION OF THE DRAWINGS

The foregoing summary and the following detailed description of exemplary embodiments of the present invention may be further understood when read in conjunction with the appended drawings, in which.

DETAILED DESCRIPTION OF THE INVENTION

In one of its aspects the present invention relates to multilayer transmission line devices and methods for design and manufacture thereof In certain aspects the present invention may provide methods for the design and manufacture of passive and active RF circuits, such as power amplifiers, oscillators, phase shifters, filters, time delay units, diplexers, etc. Such methods may also provide light weight and compact multilayer transmission lines, including waveguide, coax, microstrip, and grounded coplanar waveguide structures, for example. In another aspect, the present invention may facilitate manufacturing of the aforementioned structures with complex geometries without the need for substantial computer aided design (CAD) file manipulation.

Some exemplary device configurations in accordance with the present invention may include a complex 3D network design with few gaps between the interconnect transmission lines, such as waveguides or coaxial lines. In such an exemplary configuration, the transmission lines may be folded and ground layers can be shared between each folded line to generate high signal line density per unit volume, FIG. 1. The transmission lines of the present invention may be formed with an omni-directional propagation coax or rectangular coax or polarized propagation such as a rectangular waveguide. Both electric and magnetic channels can be used to compact the design even further by folding the path in multiple directions within a certain design volume.

Figure 1B:
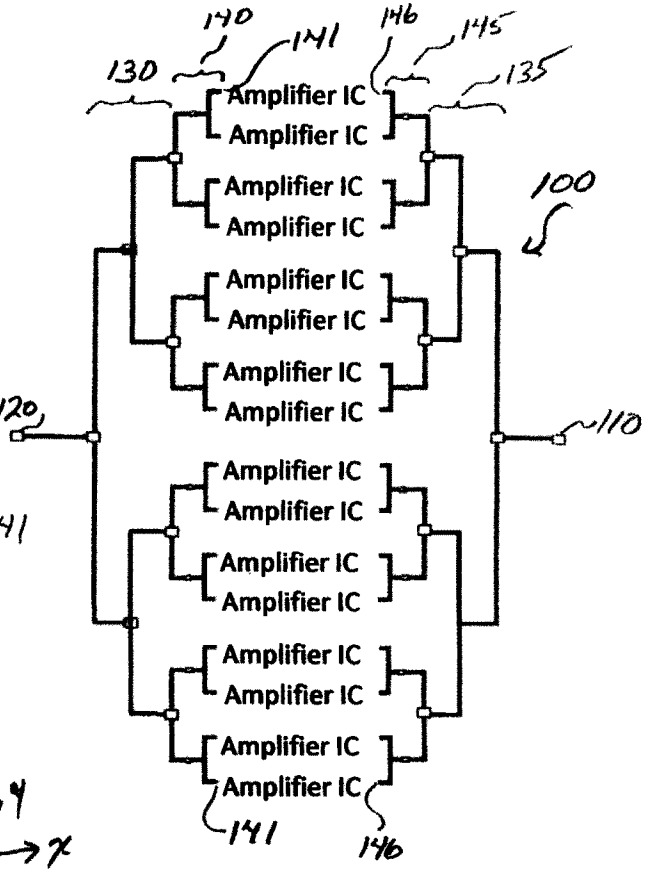
FIG. 1B schematically illustrates a wiring diagram representing the splitter/combiner of FIG. 1A.
Figure 1A:
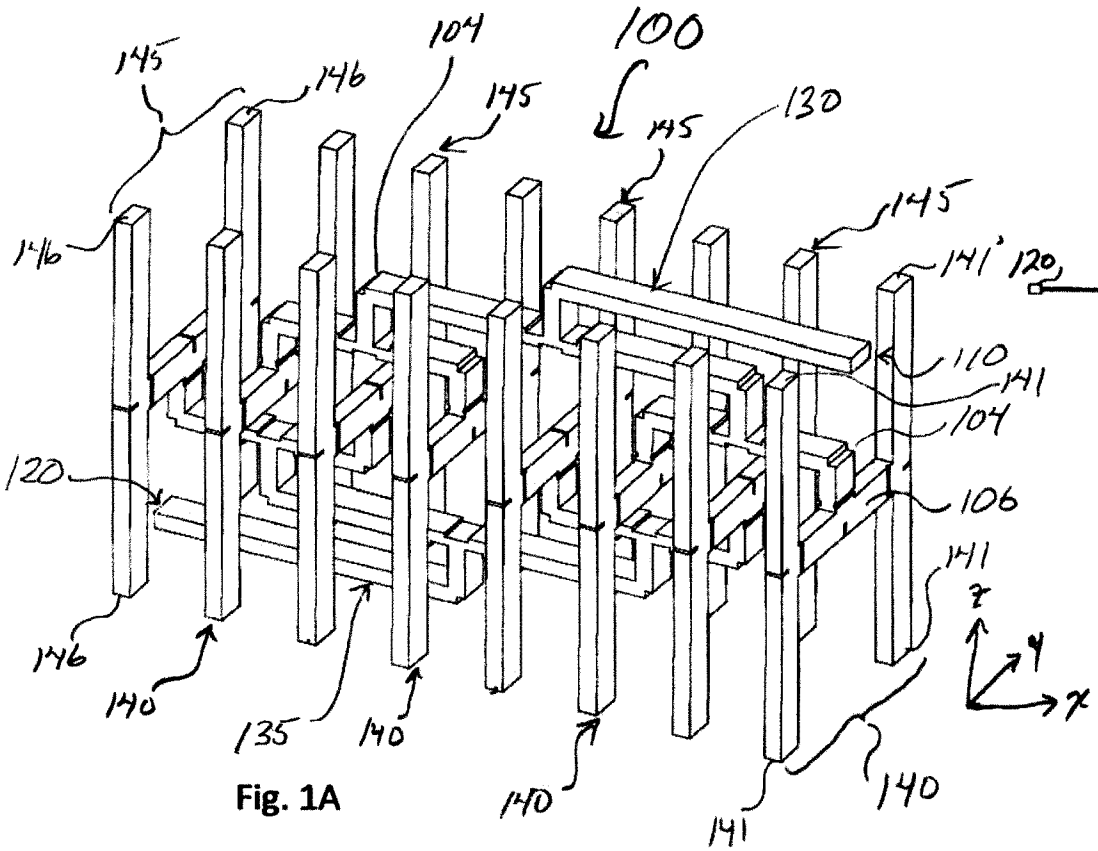
FIG. 1A schematically illustrates an exemplary WR3 waveguide 16-way back-to-back power splitter/combiner in accordance with the present invention having a physically folded structure, with the structure of the waveguide air cavities depicted (i.e., an "air model")
Figure 1C:
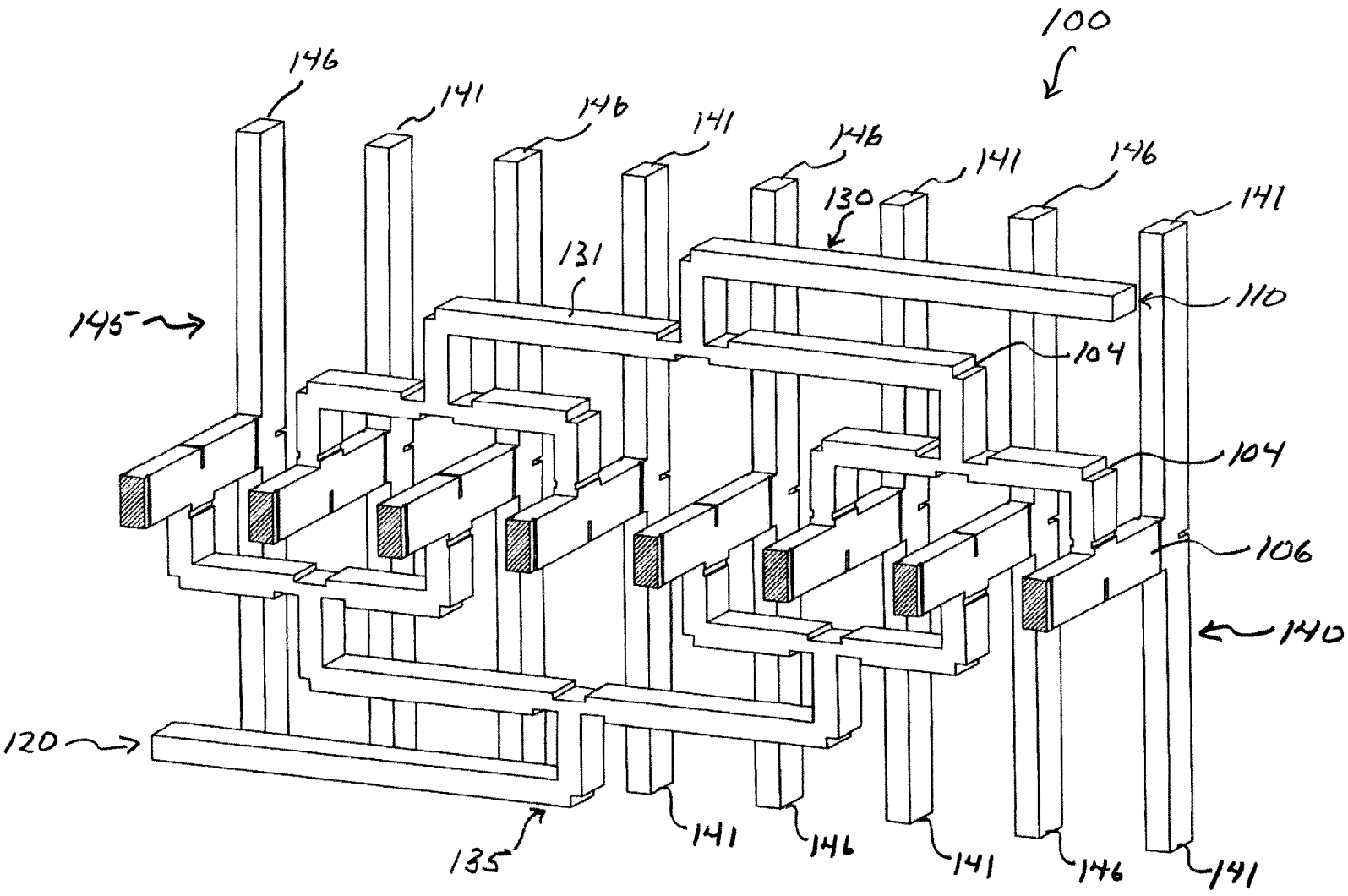
FIG. 1C schematically illustrates the splitter/combiner of FIG. 1A with a portion cutaway to reveal 4-way splitter/combiner portions.

Referring now to the figures, wherein like elements are numbered alike throughout, FIGS. 1A-1C schematically illustrate an air-model of an exemplary device in accordance with the present invention, a 16-way folded back-to-back rectangular waveguide splitter/combiner 100. (Since FIG. 1 is an air-model, "structural" elements, e.g., elements 130, 135, 140, 145, represent air or a void space in the final solid part.) The splitter/combiner 100 may include feed points for an input 110 and an output 120, and a splitter arm 130 operably connected to the input 110 to divide the input into 4 outputs, FIG. 1C. The location of the input and output 110, 120 may be selected with regard to the final configuration that is desired. The splitter arm 130 may include electric and magnetic field waveguide bends 104 to effect the folded structure and may comprise a generally planar structure disposed in the x-z plane, for example, to use the available volume. The waveguide bends 104 may be configured to keep the path length of the signal completely symmetric along the splitter arm 130 for efficient power splitting throughout the arm 130.

Four 4-way H-plane splitter modules 140 may be operably connected to the splitter arm 130 to further divide the signal into 16 portions. The H-plane splitter modules 140 may have a generally H shape and be disposed in planes that are perpendicular to the plane of the splitter arm 130, such as the y-z planes, for example. Each 4-way H-plane splitter module 140 may include four outputs 141, so that the four 4-way H-plane splitter modules 140 collectively have 4 times 4, or 16, total outputs 141. Thus, the splitter arm 130 and four H-plane splitter modules 140 may cooperate to provide the 16-way splitter of the splitter/combiner 100.

The sixteen outputs 141 of the 4-way H-plane splitter modules 140 may be connected to active or passive components, e.g., an amplifier IC chip, external to the splitter/combiner 100, FIG. 1B. Signals from such external components may then be returned to the splitter/combiner 100 to be combined at output 120. In particular, the splitter/combiner 100 may include four H-plane combiner modules 145 each of which includes four inputs 146 to receive the outputs from the external components, FIG. 1A. The combiner modules 145 may have a generally planar H shape and be disposed parallel to the splitter modules 140. Each combiner module 145 may also include a single output operably connected to a combiner arm 135 to combine the four outputs from the combiner modules 145 into the splitter/combiner output 120, FIG. 1B. The combiner arm 135 may be disposed in a plane perpendicular to the planes of the combiner modules 145, such as the same plane as the splitter arm 130. Additional structures may be added to the splitter/combiner 100 to provide additional functionality, such as filters, bias feeds, signal amplification, and phase shifting based on the overall system requirements. In certain exemplary configurations, the splitter and combiner arms 130, 135 may be identical in size and shape, FIG. 1C, as may the H-plane modules 140, 145.

Figure 2A:
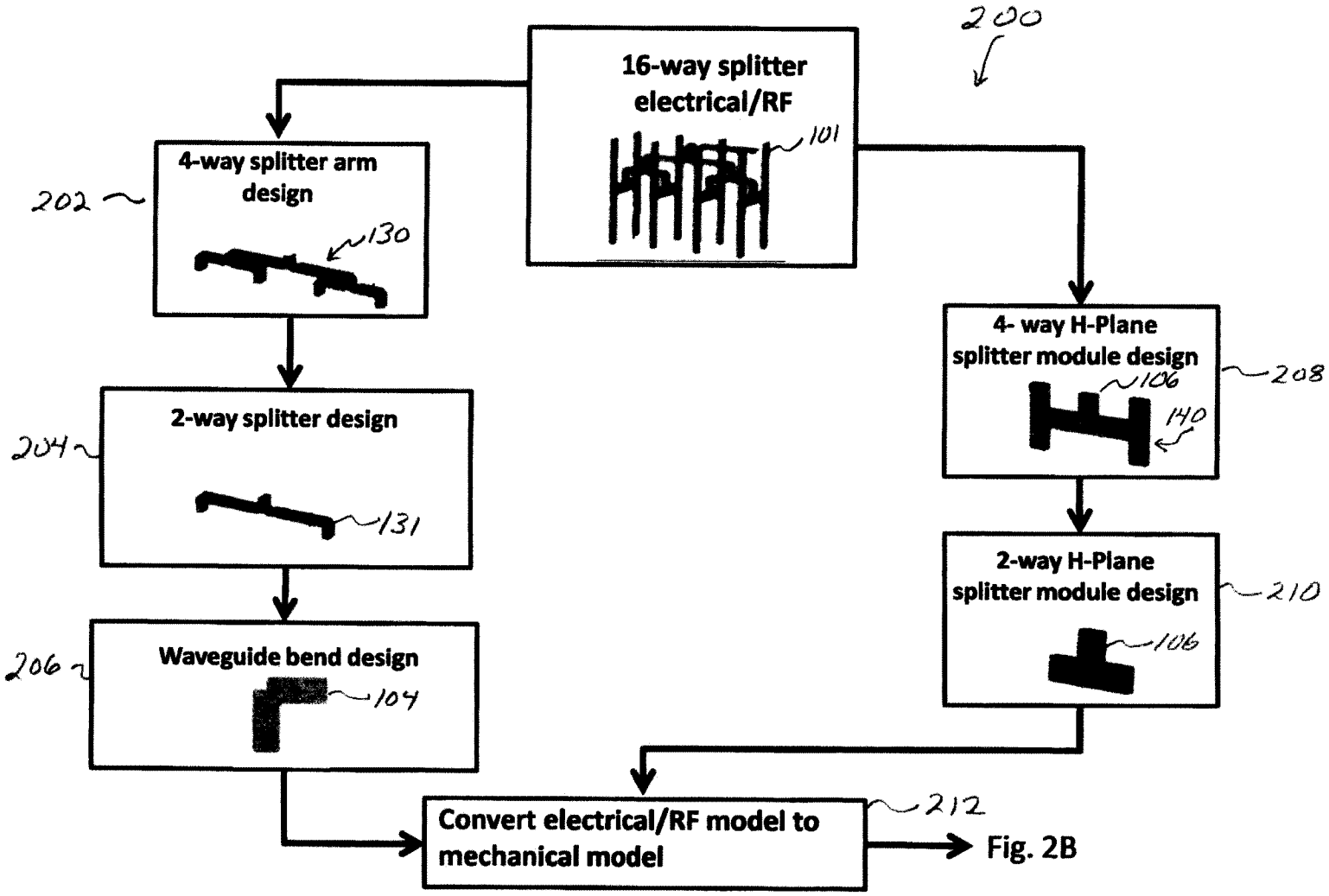
FIGS. 2A-2B schematically illustrate an exemplary design process for splitter portions of the waveguide power splitter/combiner of FIG. 1A, including both the electrical and subsequent mechanical design as a stacked architecture.
Figure 2B:
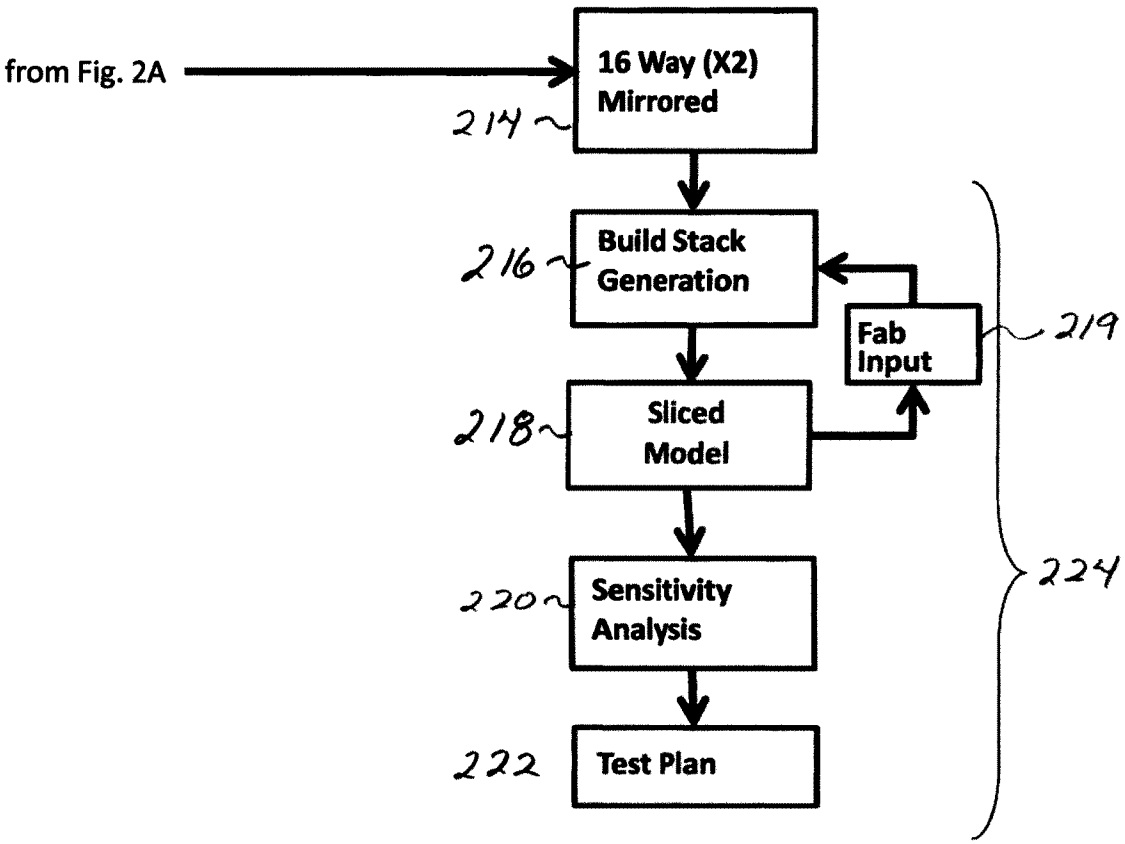

FIGS. 2A-2B illustrate a flowchart 200 of an exemplary design and manufacturing process in accordance with the present invention, where the splitter portion 101 (i.e., splitter arm 130 and H-plane splitter modules 140) of the 16-way folded back-to-back rectangular waveguide splitter/combiner 100 is shown, though the process could be used for other structures. This process may also be used for the combiner portion (i.e., combiner arm 135 and H-plane combiner modules 145).

The electrical and RF design may be performed prior to mechanical modeling, during which design performance may be optimized, such as a low insertion loss of each segment along with low reflected power from each port, i.e., low return loss. The exemplary design process may include the design of the 4-way splitter arm 130, step 202, FIG. 2A. The 4-way splitter arm 130 may provide a first branching. The 4-way splitter arm 130 may then be further broken down into a 2-way electric field waveguide splitter 131 and an electric and magnetic field waveguide bend 104, which may be separately optimized for RF performance, steps 204, 206. The 4-way H-plane splitter module 140 may also be broken down into a 2-way waveguide power splitter module 106 for performance optimization, steps 208, 210. Once the initial design of the 16-way splitter portion 101 is complete, and its RF performance such as insertion loss, isolation between ports and return loss optimized, the electrical and RF air-model may be converted into a solid, mechanical model, step 212.

As a first step the 16-way splitter portion 101 may be mirrored to provide the 16-way combiner (i.e., combiner arm 135 and H-plane combiner modules 145) to include the output network in a compact 3D volume, step 214. The overall design is folded to maximize use of the volume in which the waveguide splitter/combiner components are disposed. The mechanical model may be sliced across the volume into manufacturable slices that will fit together to form the final 3D volume 16-way splitter, step 224. The slice locations within the volume may be carefully engineered to match the fabrication process rules allowing for the high yield manufacturing, step 216. Once the slices locations are defined, each slice may then be modeled, step 218, with an associated layout. A mask set may then be generated where all the slices are placed on a single mask set and reviewed for accuracy and tolerance definition to the process design-rules, step 219. Based on the manufacturing tolerances, the slice thicknesses and their shape can be modified and re-simulated using 3D electromagnetic design tools to adhere to the fabrication process. This process may be iterated and trade-offs in performance versus manufacturing tolerance can be made for a high quality system build. Following the design optimization a sensitivity analysis, step 220, is performed to allow for performance variations due to the manufacturing and assembly tolerances to be minimized. The design for manufacturing cycle, step 224 may be an iterative process resulting in a final design of the slices where the final performance is insensitive to variations generated by the fabrication or assembly process. The design for manufacturing cycle may be completed by generating a test-plan, step 222, in which the step by step assembly and testing of the unit is described.

A particularly desirable manufacturing technology for use in fabricating the mechanical model is the metal-air-dielectric microfabrication PolyStrata® process. (U.S. Pat. Nos. 7,948,335, 7,405,638, 7,148,772, 7,012,489, 7,649,432, 7,656,256, 7,755,174, 7,898,356, 8,031,037, 8,698,577, 8,742,874, 8,542,079, 8,814,601 and/or U.S. Application Pub. Nos. 2011/0210807, 2010/0296252, 2011/0123783, 2011/0181376 and/or 2011/0181377 are incorporated herein by reference in their entirety, and hereinafter called the "incorporated PolyStrata® art." As used herein, the term "PolyStrata" refers to the devices made by, or methods detailed in, any of the aforementioned and incorporated U.S. Patents and Published Applications.) Other technologies, such as computer control machining, laser forming, wire electrical discharge machining, and so forth may provide different approaches for fabricating some parts.

Figures 3A, 3B, 3C:
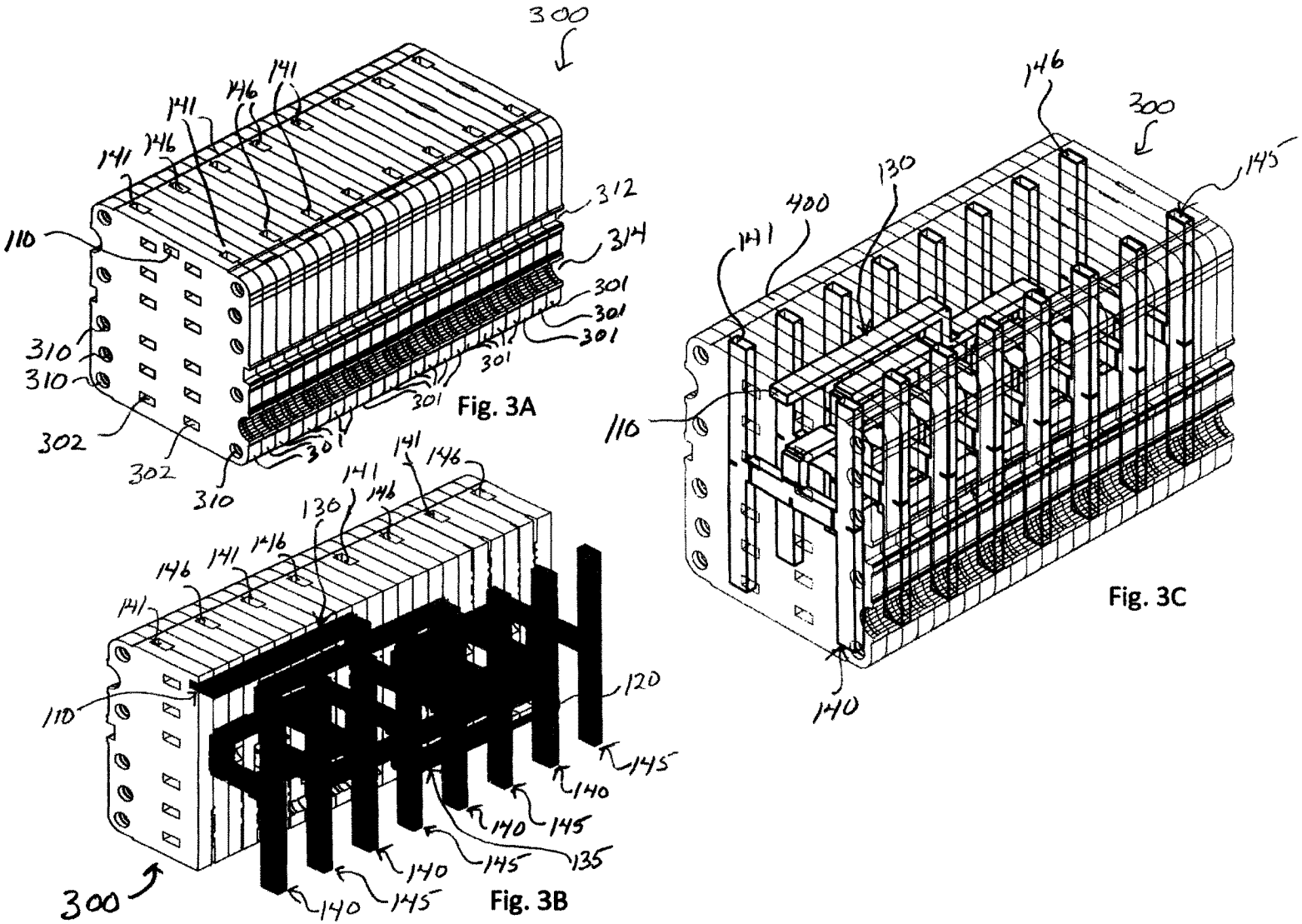
FIG. 3A schematically illustrates an isometric view of a physical realization of the power splitter/combiner of FIG. 1A designed using the process of FIGS. 2A-2B, and comprising 23 slices to form a single stack containing all electrical and mechanical features needed for the compact operation of the structure.
FIG. 3B schematically illustrates a cut-away view of the power splitter/combiner of FIG. 3A, with the waveguide air cavities shown by the shaded structures.
FIG. 3C schematically illustrates a transparent view of the power splitter/combiner of FIG. 3A.

FIGS. 3A-3C schematically illustrate an exemplary physical implementation of the air-model design of FIGS. 1A-1C to provide a waveguide block 300 with a 16-way combiner network interwoven with a 16-way divider network. In particular, FIG. 3B illustrates how the input 110, output 120, 4-way H-plane splitter and combiner modules 140, 145, splitter and combiner arms 130, 135 of the air-model of FIGS. 1A-1C may be disposed within the waveguide block 300.

The waveguide block 300 may comprise multiple slices 301 with each slice 301 fabricated independently based on the manufacturing process chosen. Each slice 301 may contain a respective portion of the air-model structures (e.g., input port 110, output port 120, 4-way H-plane splitter and combiner modules 140, 145, splitter and combiner arms 130, 135) of the air-model of FIGS. 1A-1C. Once the slices 301 have been fabricated, the slices 301 may be aligned and assembled to each other with a high degree of tolerance to provide a single rectangular volume. To aid in the alignment, registration features, such as dowel holes 310 may be provided in each slice 301 into which precision dowels may be inserted, which may optionally align the slices 301 to a secondary structure such as a flange, heat sink or integrated circuits. Alignment features may be internal or external, such as external grooves or notches 312, 314. Optional cavities 302 which do not communicate with the waveguide structures (e.g., structures 130, 135, 140, 145) may be provided to reduce the weight of the waveguide block 300 and provide air waveguide(s) through which the alignment of the slices 301 may be measured. For instance, a particular cavity 302 may be present at the same location in each and every slice 301 to provide, upon assembly, a waveguide that extends along the entire length of the waveguide block 300. After assembly of the waveguide block 300, energy can be launched through the waveguide formed by the assembled cavities 302 and the output power measured to determine insertion loss. Low insertion loss would indicate proper alignment of the slices 301, and conversely, a high or unacceptable insertion loss would indicate that the slices 301 are not well aligned.

Figures 4, 4A:
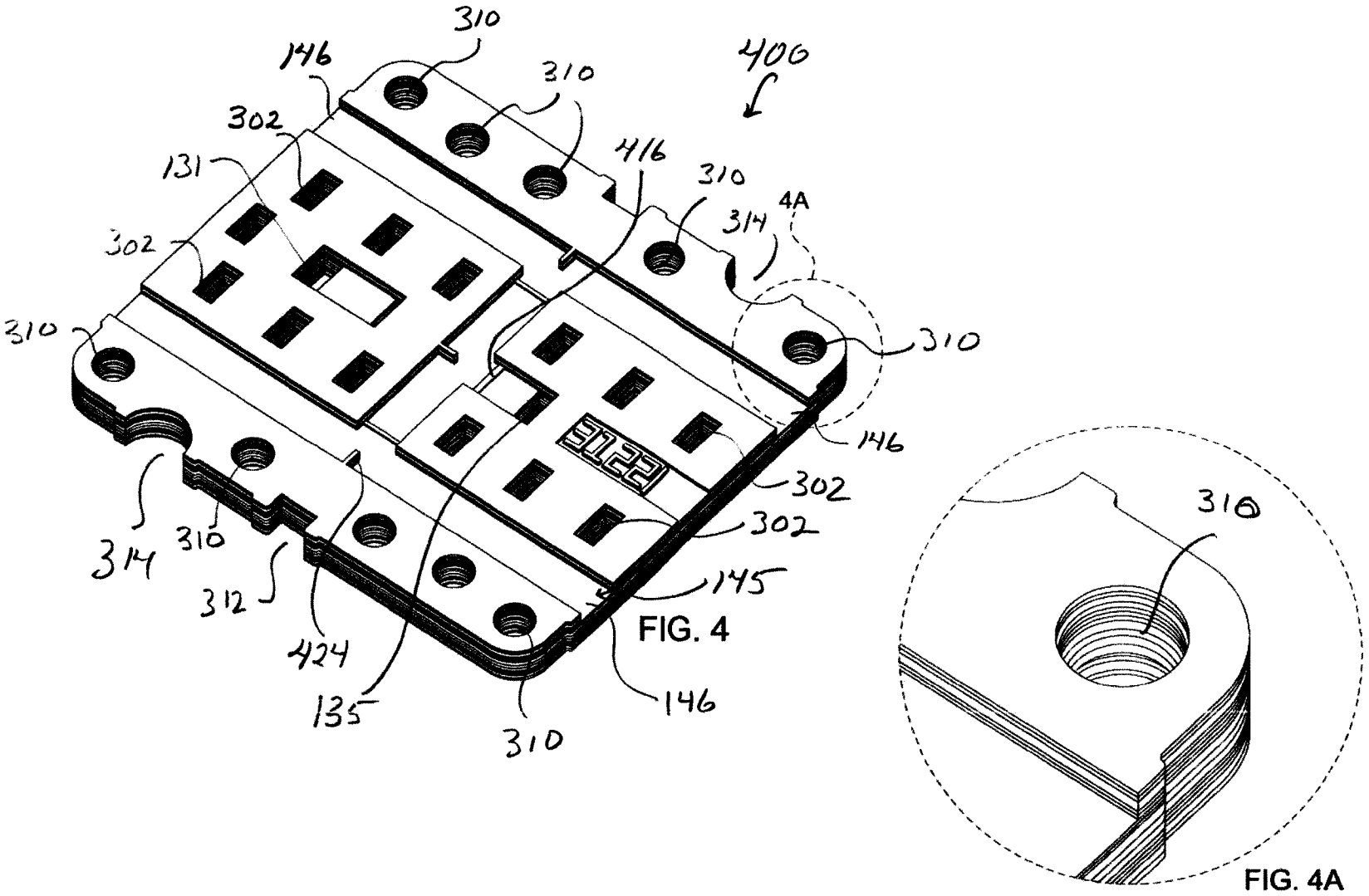
FIGS. 4 and 4A schematically illustrate a single slice of the stacked waveguide architecture of the power splitter/combiner of FIG. 3A showing complex internal cavities that provide for high RF performance.

FIGS. 4, 4A schematically illustrate a representative slice from the stack of slices illustrated in FIGS. 3A 3C, which in this particular case is the fifth such slice 400 from the front of waveguide block 300, FIG. 3C, where the reference numerals have the same meaning as variously discussed in connection with FIGS. 1A 3C. The selected slice 400 illustrates how particular portions of the rectangular waveguide splitter/combiner 100 air structures may be divided into, and disposed within, a particular slice 400. For instance, at the location of the fifth slice 400, portions of the splitter arms 130, 131 may be present, as well as portions of the 4-way H-plane combiner module 145 and combiner arm 135. The various structures contained within a slice 301, 400 may optionally extend through the depth of the slice, such as portion of the splitter arm 130, for example. Other structures may extend only a portion of the depth into the slice 301, 400, such as the 4-way H-plane combiner module 145, for example. Since the 4-way H-plane combiner module 145 does not extend the full depth, the remaining portions of the combiner module 145 may be present in an adjacent slice 301, so that when slice 400 is combined therewith, the waveguide associated with the combiner module 145 is complete. In addition, further structures may be provided to enhance performance of the device, such as septums 416, 424 which may provide wave impedance matching for low resistive power combining (or splitting, for septums present in the 4-way H-plane splitters 140).

The slices 301 may be fabricated with features such as those shown in FIGS. 4, 4A using PolyStrata® copper microfabrication multi-layered process, where each layer deposited in the process can be overlapped or exposed to build the complex layout of the design required for high electrical and mechanical performance. Specifically, layer upon layer of high resolution copper strata may be electroplated through a sacrificial plastic mold or template followed by a planarization step. Each deposited layer may then be aligned to the other as the slice 301 is fabricated and can be patterned with any shape.

The PolyStrata process may be particularly well-suited, because alignment of each deposited copper layer to another within the slice 301 can be achieved with much higher precision than required for the waveguide block 300. This allows for complex features to be built in each slice 301, and for 3D volumetric complexity to increase with each slice 301 that is stacked and bonded together. In this multilayered approach micromachined, RF cavities may be built interior to, or enclosed within, a slice 301, even though the cavity may not be accessible from either face of the slice 301. In addition, the PolyStrata® manufacturing technology allows for various metals to be incorporated into the slice 301 such as copper, silver, nickel, or gold and others depending on the requirements. Passivation layers may also be added to each slice 301 either on the surfaces only or the entire structure. The passivation may be dielectric or conductive, such as metals, for mechanical and electrical improvements to the structure. Some metals may be added to the surface to increase surface-to-surface bondability, such as adding a gold surface coating onto a copper fabricated structure. Bonding of copper surfaces to copper surfaces has been demonstrated under pressure. This can be accomplished at elevated temperatures, as well as room temperature when the surfaces are clean. Publications on surface activated bonding, the use of ultra-thin and mono-layer coatings to prevent oxidation exist in the literature. It should be clear various techniques can be used to join the independent slices 301 without causing substantial deformation to their mechanical dimensions.

Figure 5:
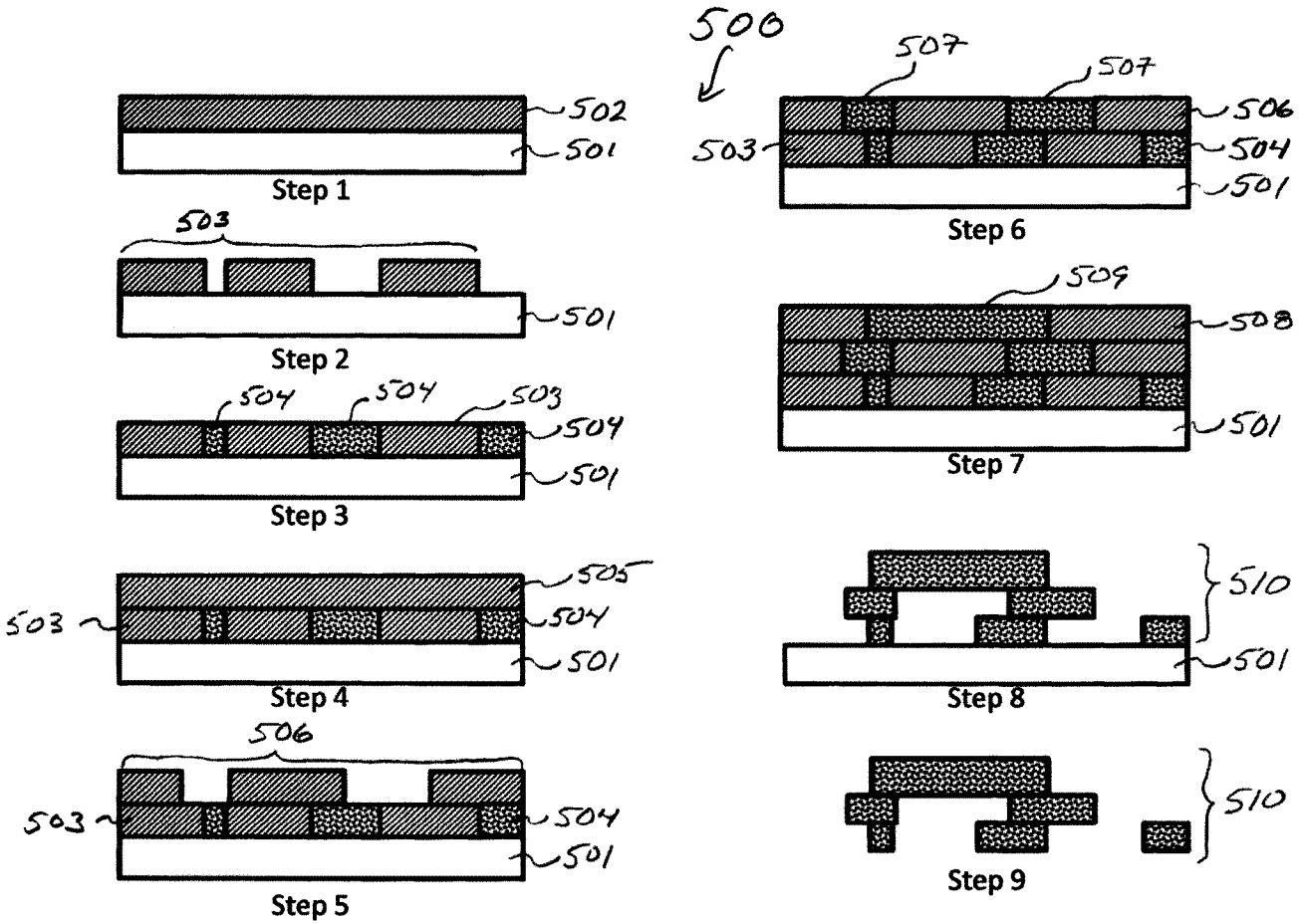
FIG. 5 schematically illustrates exemplary batch manufacturing process steps in accordance with the present invention for fabrication of a slice of a stacked waveguide architecture, such as a "multi-strata" slice shown in FIG. 4 or these same type of slices shown stacked together in FIG. 3A, for example.

FIG. 5 illustrates an exemplary batch manufacturing process of the slices 301 in accordance with the present invention, in which all the slices 301 needed for the waveguide block 300 can be included in a single fabrication mask set, allowing the slices 301 to all be built at the same time on separate areas of wafers or panels. The batch processing allows for higher resolution and alignment part-to-part, since all parts see the same fabrication process. The manufacturing cost may also be much lower than other processes that generally build parts in series like computer numerically controlled machines.

Turning to FIG. 5 in more detail, a photopolymer 502 can be spun on a carrier wafer 501 and patterned by an appropriate ultraviolet or other wavelength exposure, Step 1. The photopolymer 502 may be developed to define a template 503, Step 2, which may be electroplated to fill the template 503 with a metal 504, Step 3. Once the electroplated metal has reached a level above the height of the template 503, the metal may then be planarized and ready for the repeat of the lithography process of Steps 1-3. For example, a second layer of the photopolymer 505 may be deposited, Step 4, exposed and developed to provide an additional template 506, Step 5, which may then be filled with a metal 507 and planarized at Step 6 in a manner similar to that at Step 3. This process may be repeated as many times as needed to provide additional layers, such as a layer comprising a photopolymer 508 and a metal 509 as illustrated in Step 7. Once the layers needed have been processed, the photopolymer of the templates 503, 506, 508 may be removed to expose the air filled electroplated part 510, Step 8. The part 510, which may be a slice 301, may be released from the carrier wafer 501 following a selective etch process allowing stacking of multiple parts 510 together to form higher functionality circuits and systems. Thin seed layers that may be used whenever electroplating is to be done on any previous region that is non-conductive. Thus before each photopolymer template 503, 506 is formed, one may typically provide a thin seed layer that can be removed when the template material is removed or when each layer is planarized. Details of the PolyStrata® process are discussed in the other patents referenced herein.

Additional aspects of the fabrication process of the present invention include the high resolution alignment of the slices 301 to each other, such as through dowel holes 310, and control over the surface roughness of each slice 301, both of which are achievable via the PolyStrata® process. In this fabrication process the surface of each copper layer may be ultra-flat and smooth through a chemical mechanical polishing allowing for a high level of contact between slices 301 as they come together. This is important, because any gap between the slices 301 can reduce the performance required through high frequency leakage paths created in between the slices 301. Optionally, after assembly the slices 301 may be electroplated to metalize the rectangular waveguide block 300 and seal the inside channels (e.g., 130, 135, etc.) of the waveguide block 300. Depending on the system needs, the outside or exposed interior surfaces of the waveguide block 300 may also be electroplated, immersion plated, or passivated using an insulating material for environmental proofing considerations.

Other aspects of the fabrication process may include permanent attachment of the slices 301 together during assembly. Possible approaches may include metal-to-metal compression bonding which can be assisted through high heat and/or ultrasonic power, epoxy attach, or eutectic bonding, for example. The slices 301 may be permanently or temporarily attached to each other or other machined parts using various combined techniques allowing sections to be removed or replaced as necessary.

Figure 6B:
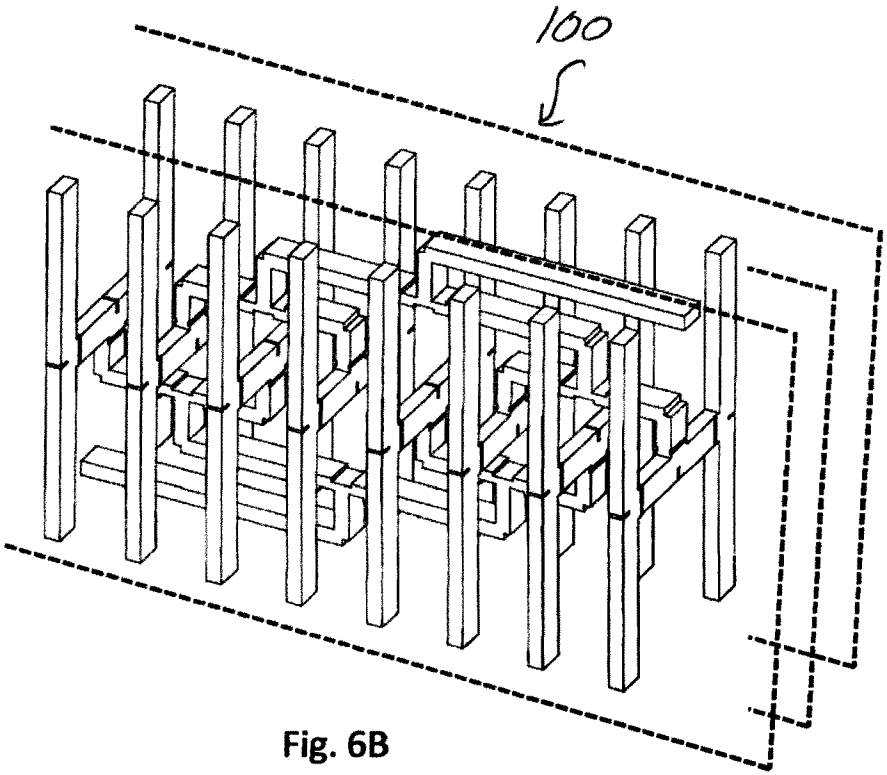
FIGS. 6A-6B schematically illustrate alternative examples of how a compact design of the present invention can be sliced in different directions for batch manufacturing, depending on tradeoffs of fabrication versus assembly into a stack.
Figure 6A:
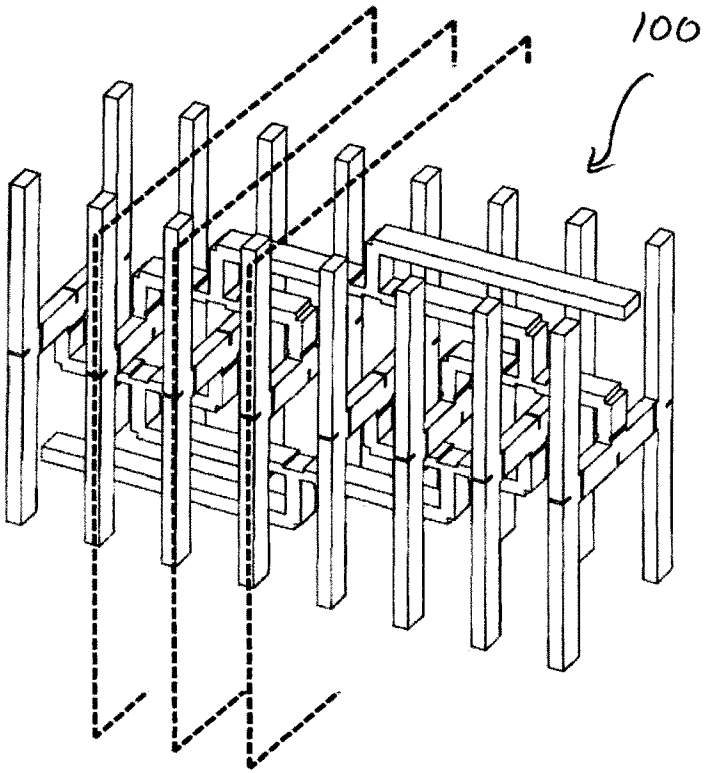

Once the air-model of the combiner/splitter 100 is created, the model may be sliced in a variety of different orientations. For example, as illustrated in FIGS. 6A-6B, respectively, the slice orientation may be perpendicular to the longitudinal axis of the combiner/splitter 100 or may be parallel to the longitudinal axis. Slicing parallel to the longitudinal axis, FIG. 6B, requires fewer slices but a larger area for each slice, while slicing perpendicular to the longitudinal axis, FIG. 6A, requires more slices but each are smaller in cross-sectional area. The slices in FIG. 6A may be 1 mm thick, for example. The tradeoff between number and slices 301 and size of each slice 301 may be based on the complexity of the circuit or device and the fabrication process. In general, yield and uniformity of the manufacturing process will determine the best option.

In some configurations, the arrangement or ordering of the slices 301 through the overall system stack can be changed to create differing sub-components or a different system altogether. The arrangement or ordering of the slices 301 can also be used to validate the performance of the system components independently before full assembly and characterization. Furthermore in some instances the slices 301 can be rotated or flipped to create other structures, for example, filters with multiple poles that can be reconfigured based on system need. An advantage of using these separate multi-layer slices 301 as building-block pieces and aligning and stacking them using means such as dowels, is that the assembly can be tested for performance and re-built or adjusted as needed before the parts are more permanently committed to an arrangement. The slices 301 can be configured or reconfigured from an inventory of such "building blocks" to rapidly create custom system configurations. This is a particular advantage over the alternative of milling where extremely high precision and suitably low surface roughness CNC milling of bulk metals is a slow and serial production processes requiring machines that are often hundreds of thousands of dollars, for example some of those made by Kern Microtechnik Gmgh in Germany. Prototyping time and cost can be greatly reduced in the approach of the present invention, such that custom hardware can be made from an "off the shelf" inventory of suitable "slices."

Figure 7:
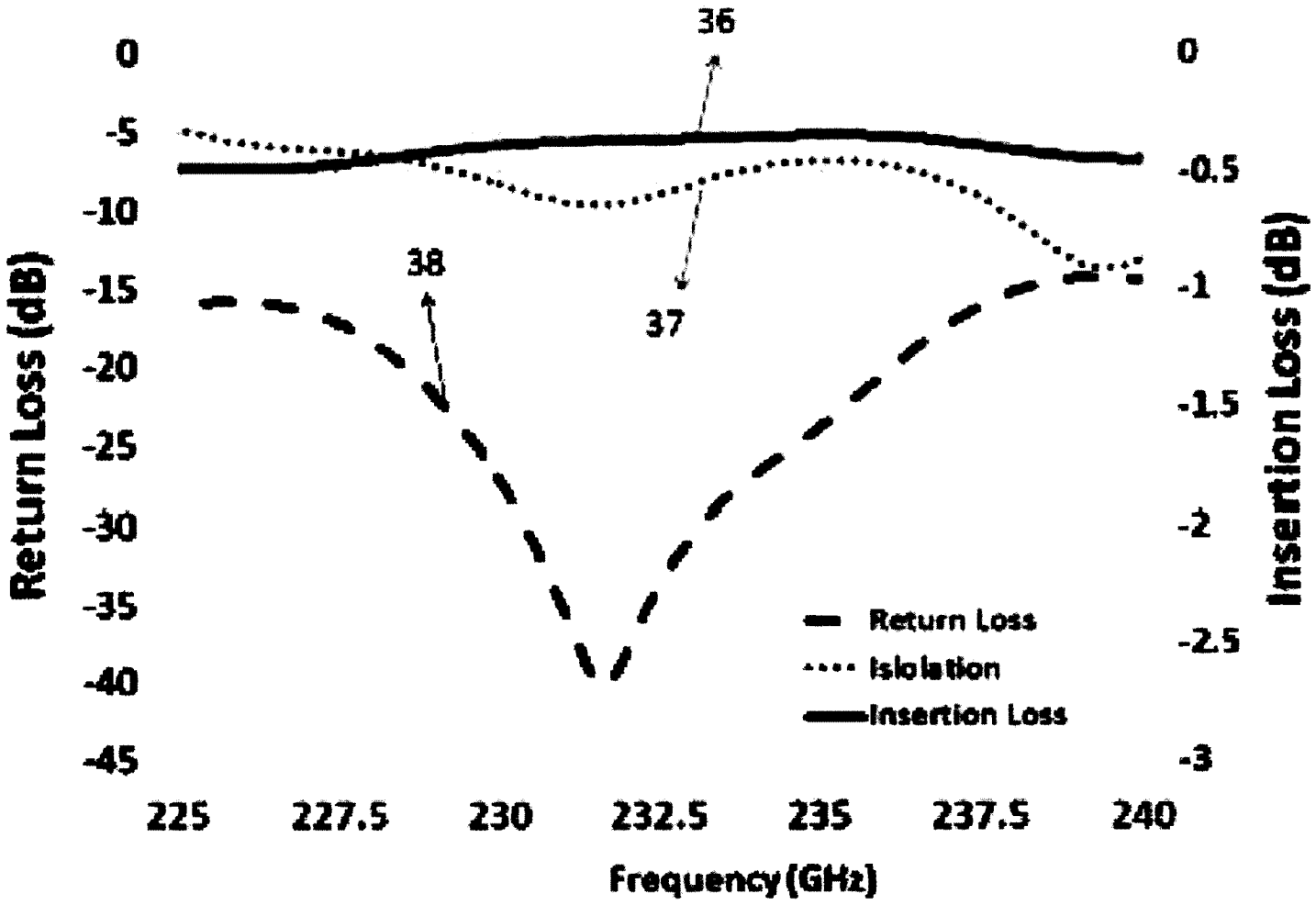
FIG. 7 illustrates the calculated high frequency performance of a mathematical model of the power combiner of FIG. 1 showing low insertion loss due to accurate build structure and compactness.

The quality performance metrics for the design of FIGS. 1A-3C are shown in FIG. 7 where the scattering parameters of a 3D electromagnetic simulation is plotted versus frequency showing low insertion loss 36, isolation 37, and high return loss 38, indicating a high degree of impedance match across the frequency of 225-240 GHz. The design can be expanded to scale in frequency while maintaining a similar high degree of performance. A main reason for the low insertion loss 36 and isolation 37 between the ports is not only a high degree of precision in manufacturing, but also the actual compact size of the waveguide block 300. This is in direct contrast to the size and accuracy of existing state of the art manufacturing techniques or combiners and other circuits and systems where parts are machined using computer numerically controlled tools.

Figure 8:
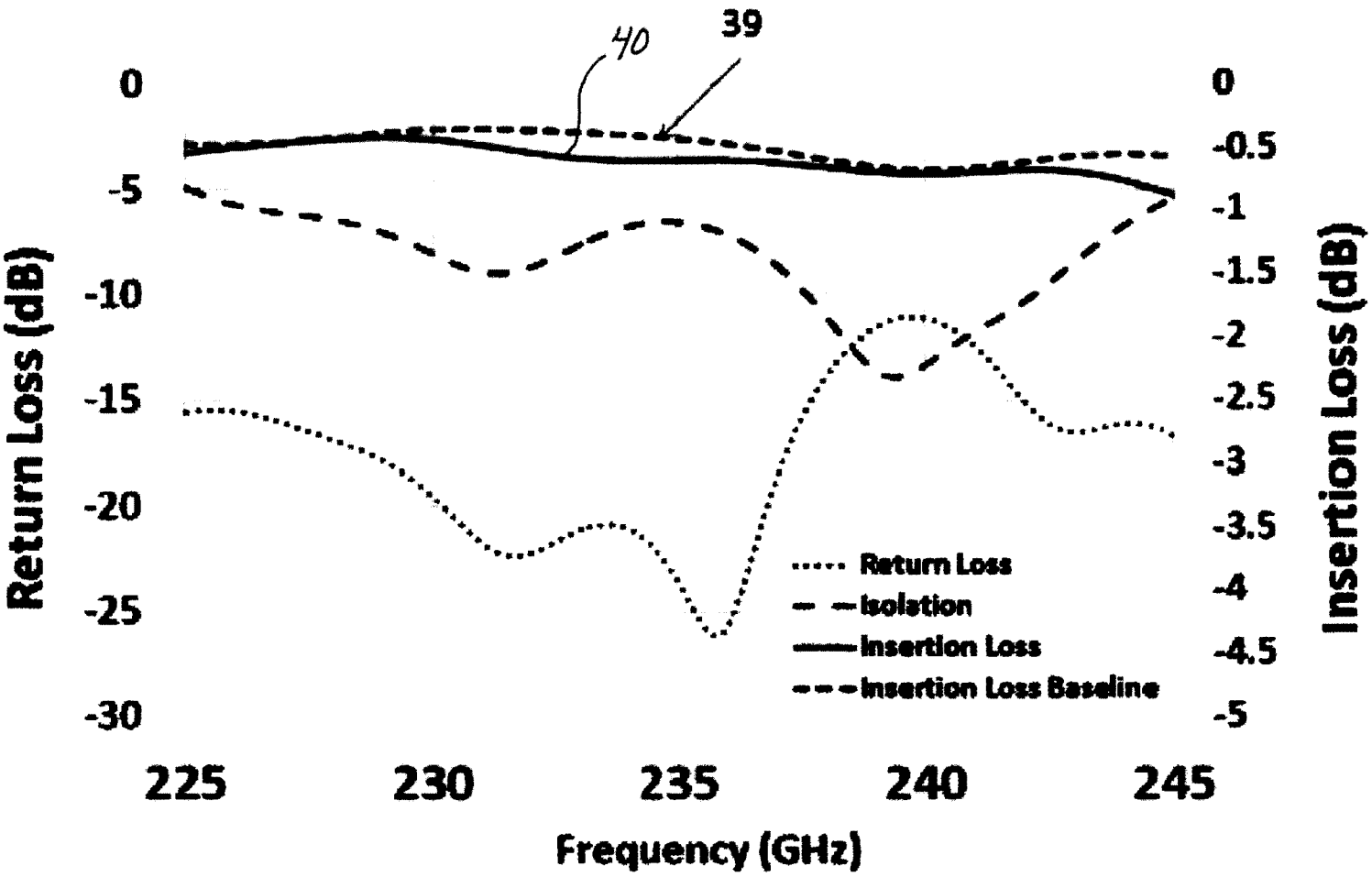
FIG. 8 illustrates the calculated sensitivity analysis of the mathematical model of FIG. 7, but with slices placed out of alignment to show negligible performance variation of the combiner, indicating a high degree of manufacturing tolerance.

FIG. 8 represents the similar metrics for waveguide block 300, such as insertion loss, but with a sensitivity analysis performed on the structure showcasing shifts in the position of the slices 301 as a function of relative position between each slice. Each slice 301 was moved about 10 and 20 μm top and bottom, left and right, and the maximum deviation from the original performance is shown in FIG. 8. The lower two curves (return loss and isolation) show little variation from the data shown in FIGS. 7, since the part is well impedance matched (return loss variations) and the isolation between ports is unaffected. The data also show that up to 20 μm of movement between the slices 301, or a similar manufacturing design change variation in assembly, does not change the insertion loss 39, 40 substantially at a frequency range of 225-240 GHz. The design sensitivity is both a function of the manufacturing tolerance and assembly of the waveguide block 300. For this exemplary design, a manufacturing tolerance of 2 μm or better throughout the slice fabrication of slices 301 can be achieved using the PolyStrata® process. The assembly tolerance is also ensured through use of alignment features embedded in each fabricated slice, such as the dowel holes 310 or positive and negative 3D form fitting features. Together the manufacturing and assembly tolerances can ensure that the design performance is maintained within the sensitivity analysis boundaries.

Figures 9A, 9B, 9C:
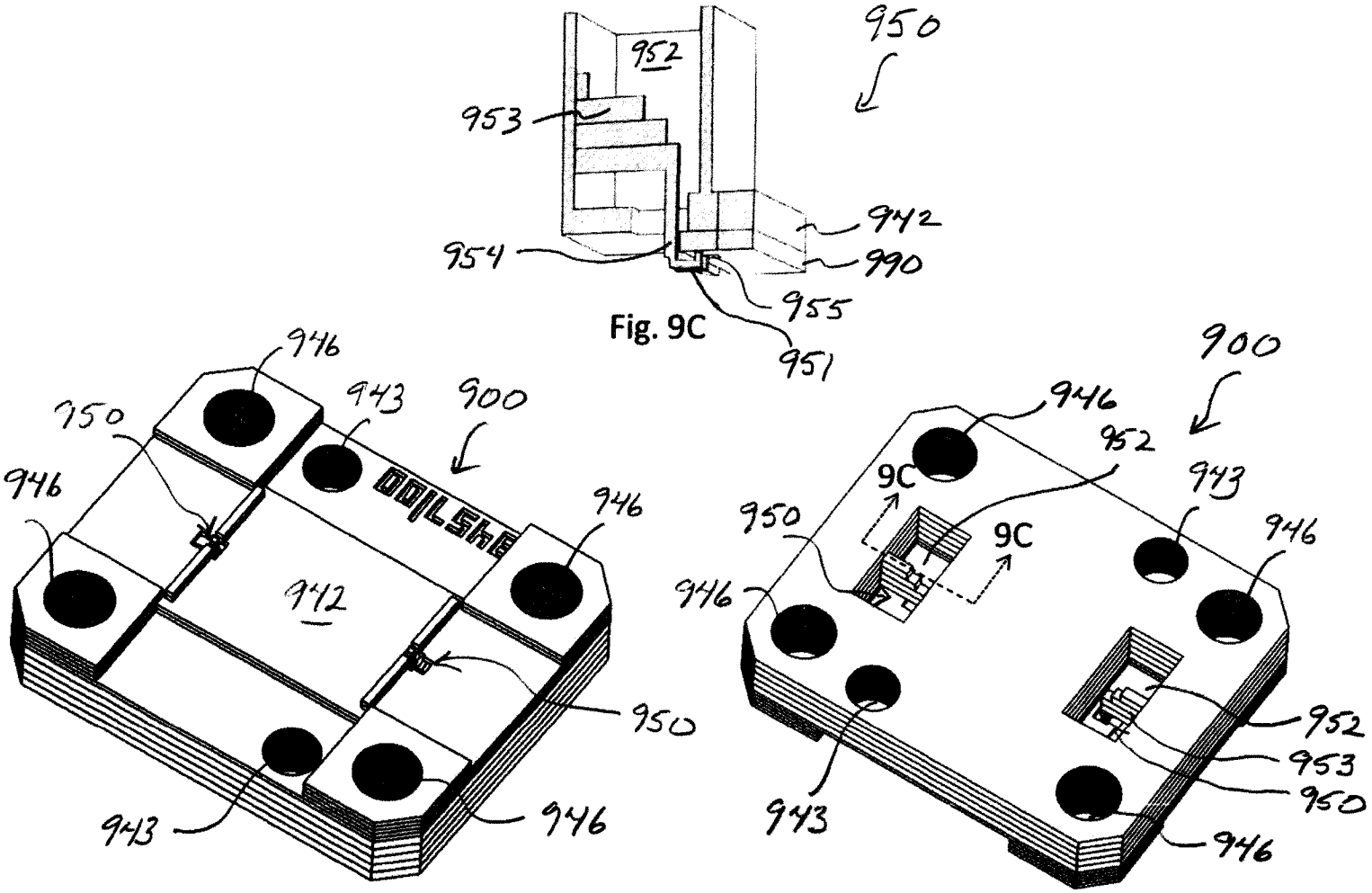
FIGS. 9A-9C schematically illustrate an exemplary waveguide to integrated circuit transition piece in accordance with the present invention, with FIG. 9A showing a top view, FIG. 9B showing a bottom view, and FIG. 9C showing a vertical waveguide to coplanar transition of FIGS. 9A and 9B, but with an IC in place.

In another of its aspects, the present invention may provide transitions 900, 1000, 1100 for connection between the rectangular waveguide block 300 and passive or active electronic/waveguide components, such as, power amplifiers, transistor circuits, or integrated circuit chips 990, for example, FIGS. 9A-11C. Considering the exemplary transition 900, FIG. 9A schematically illustrates the transition 900 oriented faced-up, where as FIG. 9B shows the transition 900 faced-down. An IC pedestal 942 may be provided on the transition 900 for mounting an integrated circuit chip 990 thereto, as seen in partial cross-section in FIG. 9C. The transition 900 may also include coplanar waveguide probes, such as two coplanar waveguide probes 950, disposed in waveguide cavities 952 of the transition 900. The waveguide probes 950 may be located adjacent the IC pedestal 942, so that with the integrated circuit chip 990 in place the waveguide probes 950 may be electrically connected to the integrated circuit chip 990, such as by a wirebond 951 to an IC bonding pad 955, FIG. 9C. The waveguide cavities 952 may be configured to communicate with the outputs and inputs 141, 146 of the waveguide block 300. Thus, power traveling through the waveguides of the outputs 141 and inputs 146 of the waveguide block 300 may be directed into the cavities 952 of the transition 900, wherein the power is converted from a waveguide mode into an electrical mode in a conductor by operation of a ridge waveguide structure 953, FIG. 9C. The ridges (also called fins) of the ridge waveguide structure 953 may configured to impedance match the waveguide to the coplanar transmission line 954 for connection to the integrated circuit chip 990. The transition 900 may be configured to provide a shortest distance between the rectangular waveguide block 300 and the integrated circuit chip 990, FIG. 9C, and hence reduce the insertion loss and minimize any variations in manufacturing build.

Figure 13:
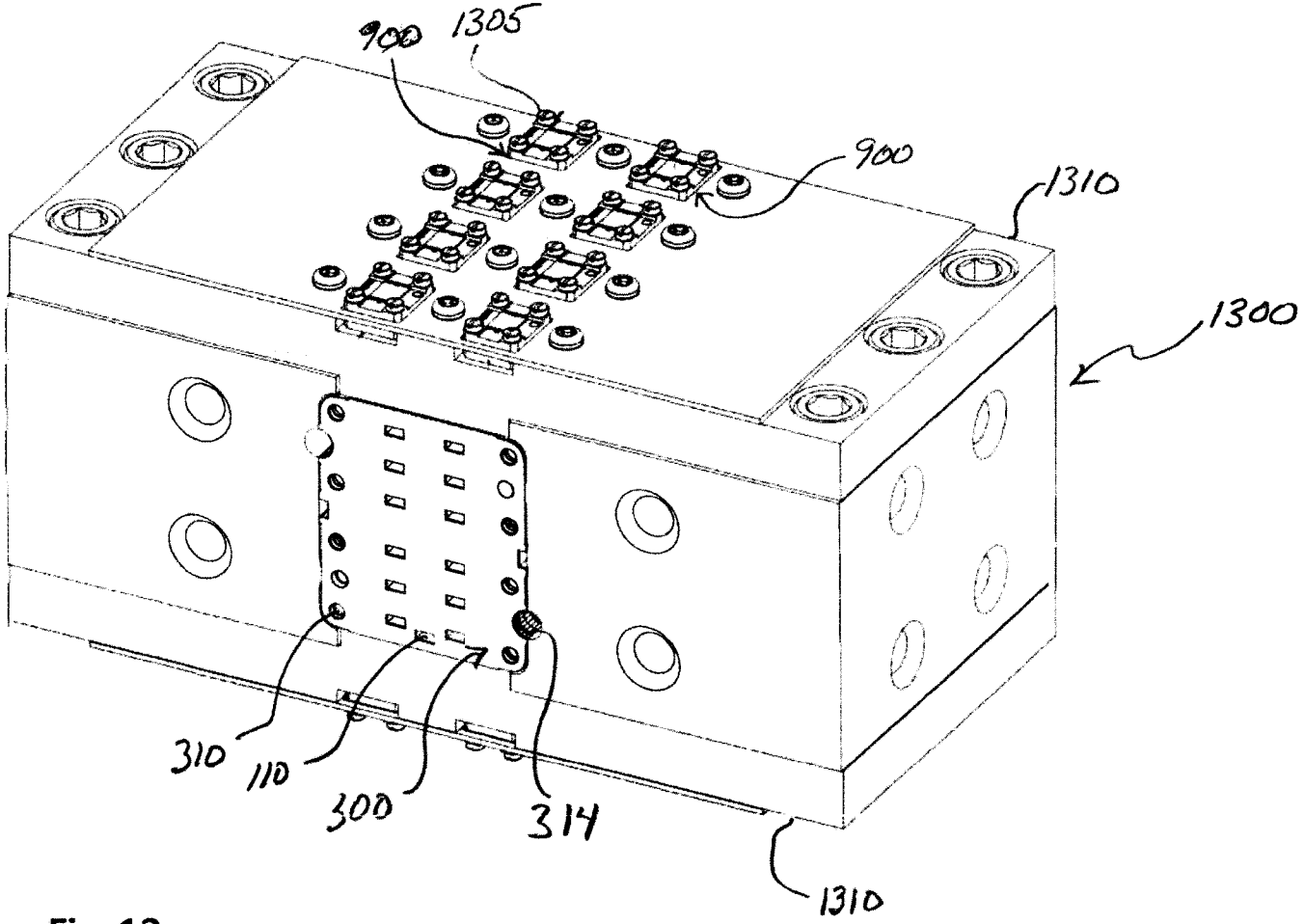
FIG. 13 schematically illustrates the power splitter/combiner of FIG. 3A enclosed within a housing with a mounting plate disposed thereon for attachment of transition pieces thereto.

Connection of the transition 900 to the waveguide block 300 may be effected by a housing 1300 and mounting plates 1310, FIG. 13. The housing 1300 may retain the waveguide block 300 and provide surfaces to which the mounting plate 1310 may be attached. Each mounting plate 1310 may include eight locations at which a transition 900 may be attached. The transitions 900 may be aligned to the mounting plates 1310 via dowel holes 943 in the transitions 900 that are registered to dowel holes in the mounting plate 1310, and may be secured to the mounting plates 1310 via screws 1305 inserted through screw holes 946, FIGS. 9A, 13. Use of the mounting plates 1310 assists in ensuring that the waveguide cavities 952 communicate with the outputs 141 of the 16-way splitter modules 140 and inputs 146 of the 16-way combiner modules 145 of the waveguide block 300.

Figure 10B:
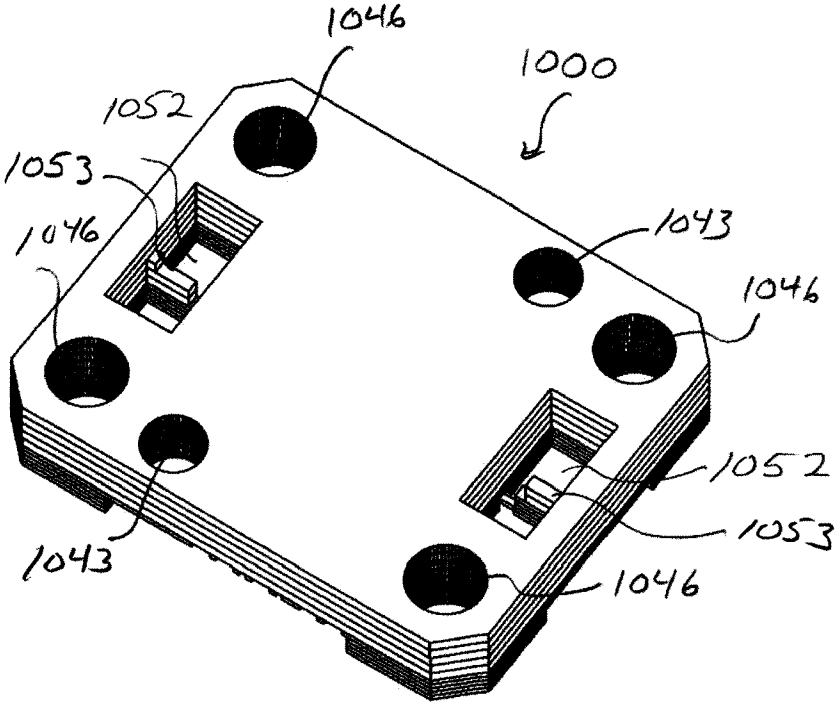
FIGS. 10A-10B schematically illustrate top and bottom views, respectively, of an exemplary waveguide to coplanar transition in accordance with the present invention having a waveguide ridge and a horizontal probe.
Figure 10A:
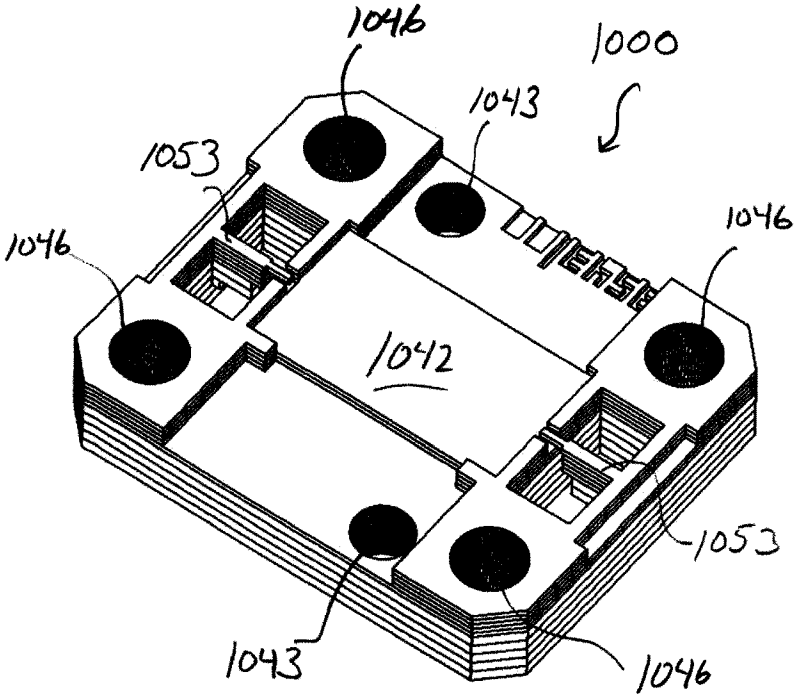
Figure 11B:
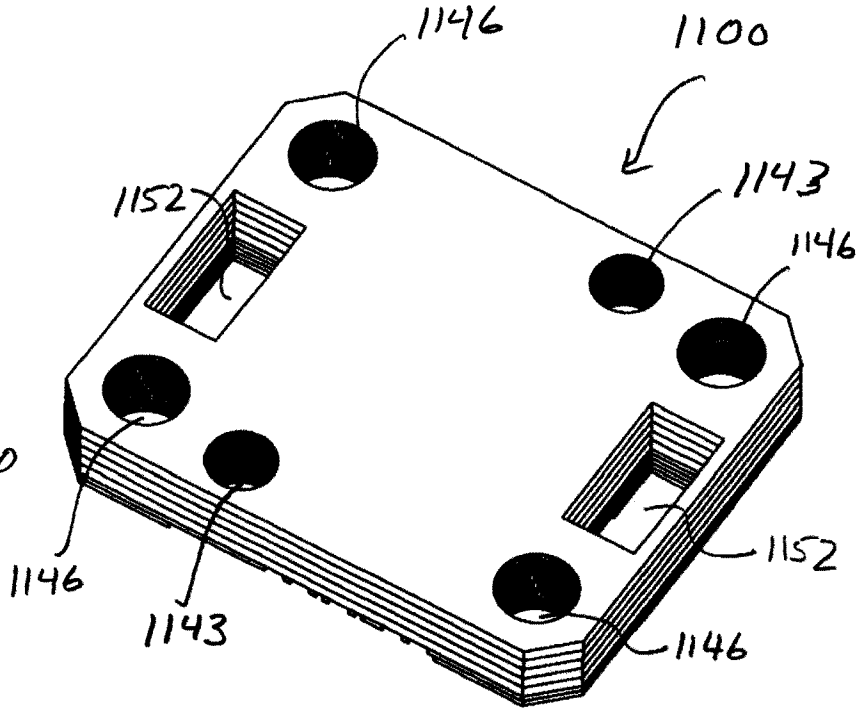
FIGS. 11A-11B schematically illustrate top and bottom views, respectively, of an exemplary waveguide to coplanar transition designed to accommodate a quartz electric field probe.
Figure 11A:
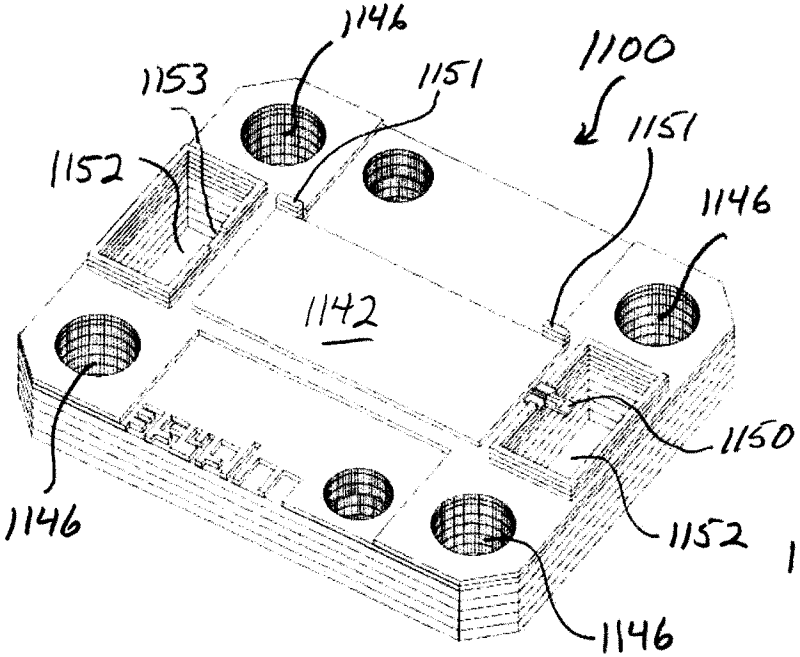

FIGS. 10A-10B schematically illustrate an alternative configuration of a transition 1000 in accordance with the present invention, having a horizontal coplanar waveguide 1053 instead of the vertical transition in FIG. 9. Like the transition 900, the transition 1000 may include dowel holes 1043, screw holes 1046, waveguide cavities 1052, and an IC pedestal 1042. In addition, FIGS. 11A-11B schematically illustrate another alternative configuration of a transition 1100 in accordance with the present invention which may also include dowel holes 1143, screw holes 1146, waveguide cavities 1152, and an IC pedestal 1142. Additionally, notches 1153 are provided in which a quartz electric field probe 1150 may be positioned to enable high degree of alignment between the probe, the integrated circuit, and waveguide cavities 1152. The probe 1150 may be attached directly to the integrated circuit bonding pad 1142. Guides 1151 on the transition part 1100 may be micro-machined for alignment of the quartz probe 1150 to an integrated circuit on the bonding pad 1142.

Each of the transitions 1000, 1100 may be mounted on the mounting plates 1310 in a similar manner to the transition 900. The transitions 900, 1000, 1100 can not only be used for a low loss interface between a rectangular waveguide, e.g., inputs and outputs 141, 146, and integrated circuit chip 990, but may also serve as a performance enhancer when the transition 900, 1000, 1100 and the integrated circuit 900 are connected together in a system. In one such exemplary configuration of the transition, e.g., transition 900, the impedance matching can be optimized to be inductive at the design frequency inclusive of the wirebond 951 for connection to the integrated circuit chip 990, and the respective IC bonding pads 955. The wirebond 951 and IC bonding pads 955 could be capacitive, so the wirebond inductance and the chip bonding pad capacitance may resonate together and create a low loss signal path through the chip 990. A benefit of larger capacitance, which larger bonding pads 955 of a chip 990 create, is the ease of attachment using wirebonds 951 leading to higher reliability and yield of the overall manufacturing process.

Figure 12B:
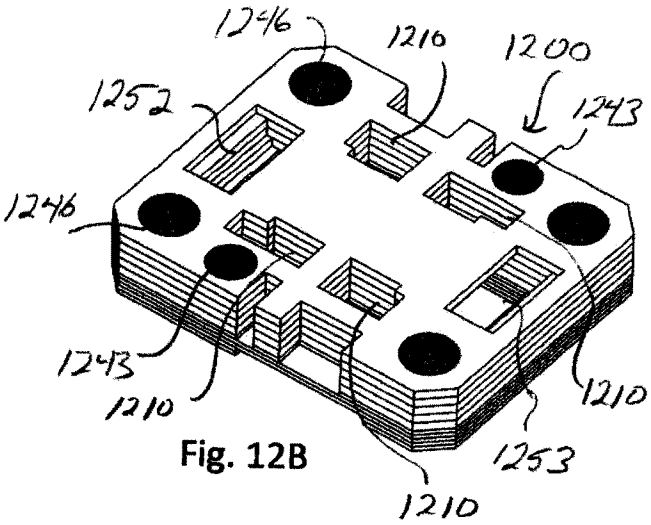
FIGS. 12A-12B schematically illustrate top and bottom views, respectively, of an exemplary translation piece in accordance with the present invention built to accommodate various geometries of integrated circuits.
Figure 12A:
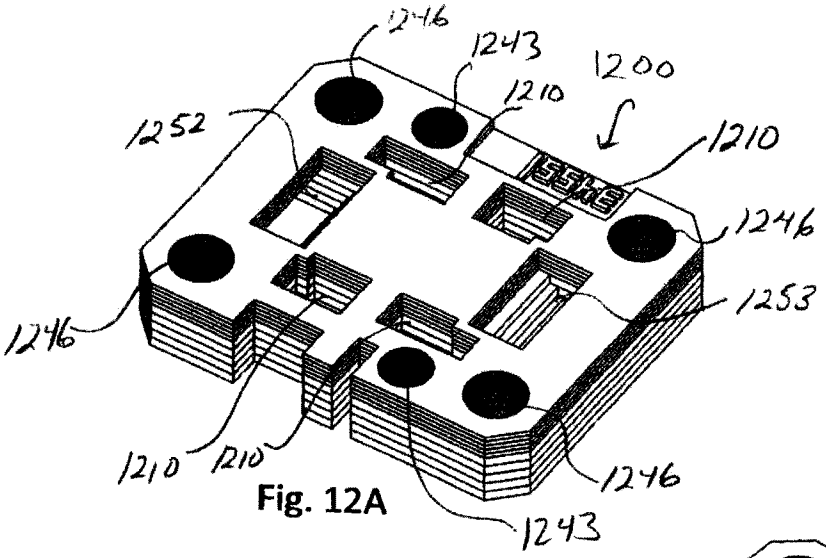
Figure 12C:
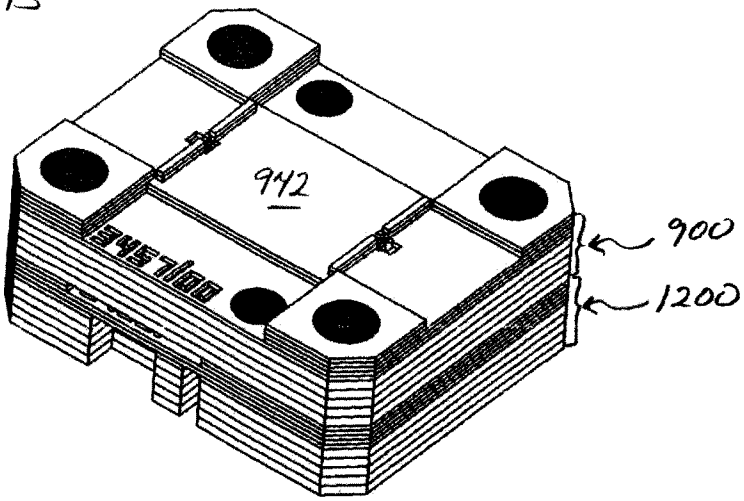
FIG. 12C schematically illustrates the transition piece of FIG. 9A stacked on top of the translation piece of FIG. 12A.

In yet another aspect of the present invention, FIGS. 12A-12C schematically illustrate a translation 1200 which allows waveguide cavities 1052 to be translated to another location to accommodate any size integrated circuit. The translation 1200 can be placed under a transition piece, such as transition 900, FIG. 12C, and can also be used for further impedance tuning if necessary in addition to that in the transition 900. Like the transition 900, the translation 1200 may include dowel holes 1243, screw holes 1246, waveguide cavities 1252, 1253. The cavities 1252, 1253 show a staggered waveguide taper where every layer in the slice is used to slightly move the waveguide cavity 1252, 1253 in one direction resembling a staircase. This allows for high performance transition of the cavity 1252, 1253 from one location to another and allow the accommodation of various size ICs. In addition, the translation 1200 may included visual alignment features 1210. The transitions 900, 1000, 1100 and translation 1200 may be made by the process illustrated in FIG. 5.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A stacked waveguide structure, comprising a plurality of solid metal waveguide slices, each waveguide slice having an upper and opposing lower surfaces and comprising at least one waveguide cavity disposed therein, where selected pairs of the waveguide slices are disposed adjacent one another, with the waveguide cavity of each slice of a selected pair registered to one another so the waveguide cavities of the selected pair of slices communicate with one another to provide at least one waveguide within the stacked waveguide structure, each slice comprised of a plurality of planar metal layers stacked parallel to the upper surface in contact with and joined to one another to provide a stack of planar metal layers which form each slice.

2. The stacked waveguide structure according to claim 1, wherein the at least one waveguide comprises a waveguide splitter.

3. The stacked waveguide structure according to claim 1, wherein the at least one waveguide comprises a waveguide combiner.

4. The stacked waveguide structure according to claim 1, wherein at least one waveguide comprises a branched structure.

5. The stacked waveguide structure according to claim 1, wherein the at least one waveguide comprises a plurality of waveguides which do not communicate with one another.

6. The stacked waveguide structure according to claim 1, wherein the metal comprises copper.

7. The stacked waveguide structure according to claim 1, comprising a probe disposed within the waveguide cavity, the probe configured to convert electromagnetic energy disposed within the waveguide cavity into electrical energy within the probe, the probe comprised of a plurality of planar metal layers stacked in contact with and joined to one another to provide a stack of planar layers which form the probe.

8. The stacked waveguide structure according to claim 1, comprising a waveguide input at a selected surface of the stacked waveguide structure, and comprising a plurality of waveguide outputs at a selected surface of the stacked waveguide structure.

9. The stacked waveguide structure according to claim 8, comprising an integrated circuit chip disposed in electromagnetic communication with one of the waveguide outputs.

10. The stacked waveguide structure according to claim 1, comprising a waveguide output at a selected surface of the stacked waveguide structure, and comprising a plurality of waveguide inputs at a selected surface of the stacked waveguide structure.

11. The stacked waveguide structure according to claim 10, comprising an integrated circuit chip disposed in electromagnetic communication with one of the waveguide inputs and one of the waveguide outputs.

12. The stacked waveguide structure according to claim 11, wherein the integrated circuit chip comprises a power amplifier.

13. The stacked waveguide structure according to claim 11, comprising a waveguide transition disposed between the integrated circuit chip and a selected one of the waveguide outputs, the transition comprising a waveguide cavity therein and disposed in electromagnetic communication with the selected waveguide output.

14. The stacked waveguide structure according to claim 13, comprising a probe disposed within the waveguide cavity of the transition, the probe configured to convert electromagnetic energy disposed within the waveguide cavity of the transition into electrical energy within the probe, and wherein the probe is disposed in electrical communication with the integrated circuit chip.

15. The stacked waveguide structure of claim 1, wherein the waveguide cavity of a selected slice extends through the depth of the stack of planar metal layers to provide openings on opposing surfaces of the slice.

16. The stacked waveguide structure according to claim 1, wherein the waveguide cavity of a selected slice extends partially into the depth of the slice through a plurality of the planar metal layers.

17. The stacked waveguide structure according to claim 1, wherein a selected slice comprises two waveguide cavities oriented orthogonal to one another within the slice.

18. The waveguide structure according to claim 1, wherein at least a portion of the at least one waveguide is disposed orthogonal to the upper surface.

19. The stacked waveguide structure according to claim 1, wherein at least a portion of the at least one waveguide is disposed parallel to the upper surface.

20. A method of creating a stacked waveguide structure, comprising:

i) forming a plurality of solid metal waveguide slices each having at least one waveguide cavity disposed therein, comprising the steps of:

depositing a plurality of layers on top of one another to create a stacked layer-upon-layer structure, wherein the layers comprise one or more of a metal material and a sacrificial material, the sacrificial material having an opening disposed therein filled with the metal material; and removing the sacrificial material to create the at least one waveguide cavity at the location of the sacrificial material; and ii) aligning and joining the plurality of waveguide slices to one another so the waveguide cavities of the slices communicate with one another to provide at least one waveguide within the stacked waveguide structure, wherein the solid metal waveguide slices comprise the slices of any one of claims 15-19.

* * * * *